US008597034B2

(12) United States Patent
Morana et al.

(10) Patent No.: US 8,597,034 B2
(45) Date of Patent: Dec. 3, 2013

(54) INTERFACE SYSTEM HAVING AN INTERFACE WITH SIGNAL AND GROUND TRACES CONNECTED TO INTERFACE PINS

(75) Inventors: Frank Morana, Shrewsbury, MA (US); Mark Ayzenberg, Hudson, NH (US)

(73) Assignee: Hypertronics Corporation, Hudson, MA (US)

( * ) Notice: Subject to any disclaimer, the term of this patent is extended or adjusted under 35 U.S.C. 154(b) by 0 days.

(21) Appl. No.: 13/424,181

(22) Filed: Mar. 19, 2012

(65) Prior Publication Data

US 2012/0258634 A1 Oct. 11, 2012

Related U.S. Application Data

(60) Provisional application No. 61/472,490, filed on Apr. 6, 2011.

(51) Int. Cl.
*H01R 12/00* (2006.01)

(52) U.S. Cl.
USPC ..... 439/65

(58) Field of Classification Search
USPC ..... 439/65, 63, 79, 541.5, 843
See application file for complete search history.

(56) References Cited

U.S. PATENT DOCUMENTS

| | | | | |
|---|---|---|---|---|
| 3,229,356 | A * | 1/1966 | Bonhomme | 29/861 |
| 3,470,527 | A | 9/1969 | Bonhomme | |
| 5,197,893 | A | 3/1993 | Morlion et al. | |
| 6,102,746 | A | 8/2000 | Nania et al. | |
| 6,520,998 | B1 * | 2/2003 | Scholler et al. | 439/851 |
| 6,848,922 | B2 * | 2/2005 | Coughlan et al. | 439/181 |
| 7,186,121 | B1 | 3/2007 | Costello et al. | |
| 7,311,566 | B2 * | 12/2007 | Dent | 439/843 |

FOREIGN PATENT DOCUMENTS

| | | |
|---|---|---|
| EP | 1158620 | 11/2001 |
| EP | 1638170 | 3/2006 |

* cited by examiner

*Primary Examiner* — Chandrika Prasad
(74) *Attorney, Agent, or Firm* — Snell & Wilmer LLP

(57) ABSTRACT

An interface system may be used for connecting a mother board with a peripheral device board. The interface system may include a mother interface and a daughter interface. The mother interface may establish a connection portal for the mother board, and the daughter interface may establish a connection portal for the peripheral device board. The interface system may be equipped with a socket with multi-contact surface for providing high speed, high performance, and low noise data transmission. The interface system may be ruggedized with various stabilizing mechanisms, such that it may deliver consistent and reliable performance under harsh military and/or aerospace conditions.

20 Claims, 18 Drawing Sheets

INTERFACE SYSTEM HAVING AN INTERFACE WITH SIGNAL AND GROUND TRACES CONNECTED TO INTERFACE PINS

CROSS REFERENCE TO RELATED APPLICATIONS

This application claims the benefit and priority of U.S. Provisional Application No. 61/472,490, filed on Apr. 6, 2011, the entire contents of which are hereby incorporated by reference.

BACKGROUND

1. Field

The present invention generally relates to the field of interface systems, and more particularly to a high speed interface system for connecting mother boards and peripheral device boards.

2. Description of the Related Art

In a computer system, a mother board is generally used for hosting a number of processing devices, such as a microprocessor and a field programmable gate array (FPGA). These processing devices may rely on one or more peripheral devices to transmit, receive, and store data. In order to provide a flexible computing platform, these peripheral devices may be selectively connected to the processing devices. As such, these peripheral devices may or may not be included on the mother board. Instead, the computer system may have one or more peripheral device boards for hosting these peripheral devices. Each of the peripheral device boards may be plugged into or removed from the mother board.

Conventional interface systems may be used to facilitate the coupling and decoupling between the mother board and the peripheral device board. These conventional interface systems may perform reasonably well under normal conditions. However, when being installed in military and/or aerospace apparatuses, which may be deployed in harsh operating environment, these conventional interface systems may fail to perform reliably and consistently. Mainly, the electrical couplings established by these conventional interface systems tend to be unstable when they are under a certain amount of stress, shock, and/or temperature variances.

Thus, there is a need for an interface system that can deliver consistent and reliable performance under harsh operating conditions.

SUMMARY

The present invention may provide an interface system for use in a high speed communication device. The high speed communication device may include a mother board and a peripheral device board, both of which may be installed in a military and/or aerospace apparatus. The interface system may be used for establishing a wired communication link between the mother board and the peripheral device board.

The interface system may include a mother interface and a daughter interface. The mother interface may establish a connection portal for the mother board, and the daughter interface may establish a connection portal for the peripheral device board. The interface system may be equipped with a socket having a multi-contact surface for providing high speed, high performance, and low noise data transmission. The interface system may be ruggedized with various stabilizing mechanisms, such that it may deliver consistent and reliable performance under harsh military and/or aerospace conditions.

In one embodiment, the present invention may provide an interface system for connecting a first electrical device board with a second electrical device board. The interface system may include a first interface configured to be connected to the first electrical device board and having an interface pin. The interface system may include a second interface configured to be connected to the second electrical device board and having an interface socket, the interface socket configured to receive the interface pin and establish a plurality of contact points comprising a plurality of contact lines distributed across a surface of the interface pin.

In another embodiment, the present invention may provide an interface system for connecting a mother board with a peripheral device board. The interface system may comprise a daughter interface configured to be connected to the peripheral device board and having a plurality of interface pins. The daughter interface may further include a connecting surface configured to face the peripheral device board, an interface surface positioned perpendicular to the connecting surface and supporting the plurality of interface pins and a plurality of connecting pins protruding from the connecting surface and configured to be inserted into the peripheral device board. The interface system may also comprise a mother interface configured to be connected to the mother board and having a plurality of interface sockets, each of the plurality of interface sockets configured to receive one of the plurality of interface pins and establish a plurality of contact lines distributed across a surface of the corresponding interface pin. The mother interface may further include a connecting surface configured to face the mother board, an interface surface opposing the connecting surface of the mother interface and supporting the plurality of interface sockets and a plurality of connecting pins protruding from the connecting surface of the mother interface and configured to be inserted into the mother board.

In still another embodiment, the present invention may be a method for interfacing a first device board with a second device board. The method may comprise establishing a first interface having an interface pin and configured to be connected to the first device board. The method may further comprise establishing a second interface having an interface socket and configured to be connected to the second device board. The method may further comprise receiving the interface pin within the interface socket to establish a plurality of contact lines having an angular gradation across a surface of the interface pin.

BRIEF DESCRIPTION OF THE DRAWINGS

Other systems, methods, features, and advantages of the present invention will be or will become apparent to one with skill in the art upon examination of the following figures and detailed description. It is intended that all such additional systems, methods, features, and advantages be included within this description, be within the scope of the present invention, and be protected by the accompanying claims. Component parts shown in the drawings are not necessarily to scale, and may be exaggerated to better illustrate the important features of the present invention. In the drawings, like reference numerals designate like parts throughout the different views, wherein:

DETAILED DESCRIPTION

Apparatus, systems and methods that implement the embodiment of the various features of the present invention will now be described with reference to the drawings. The drawings and the associated descriptions are provided to illustrate some embodiments of the present invention and not to limit the scope of the present invention. Throughout the drawings, reference numbers are re-used to indicate correspondence between reference elements. In addition, the first digit of each reference number indicates the figure in which the element first appears.

Figure 1:
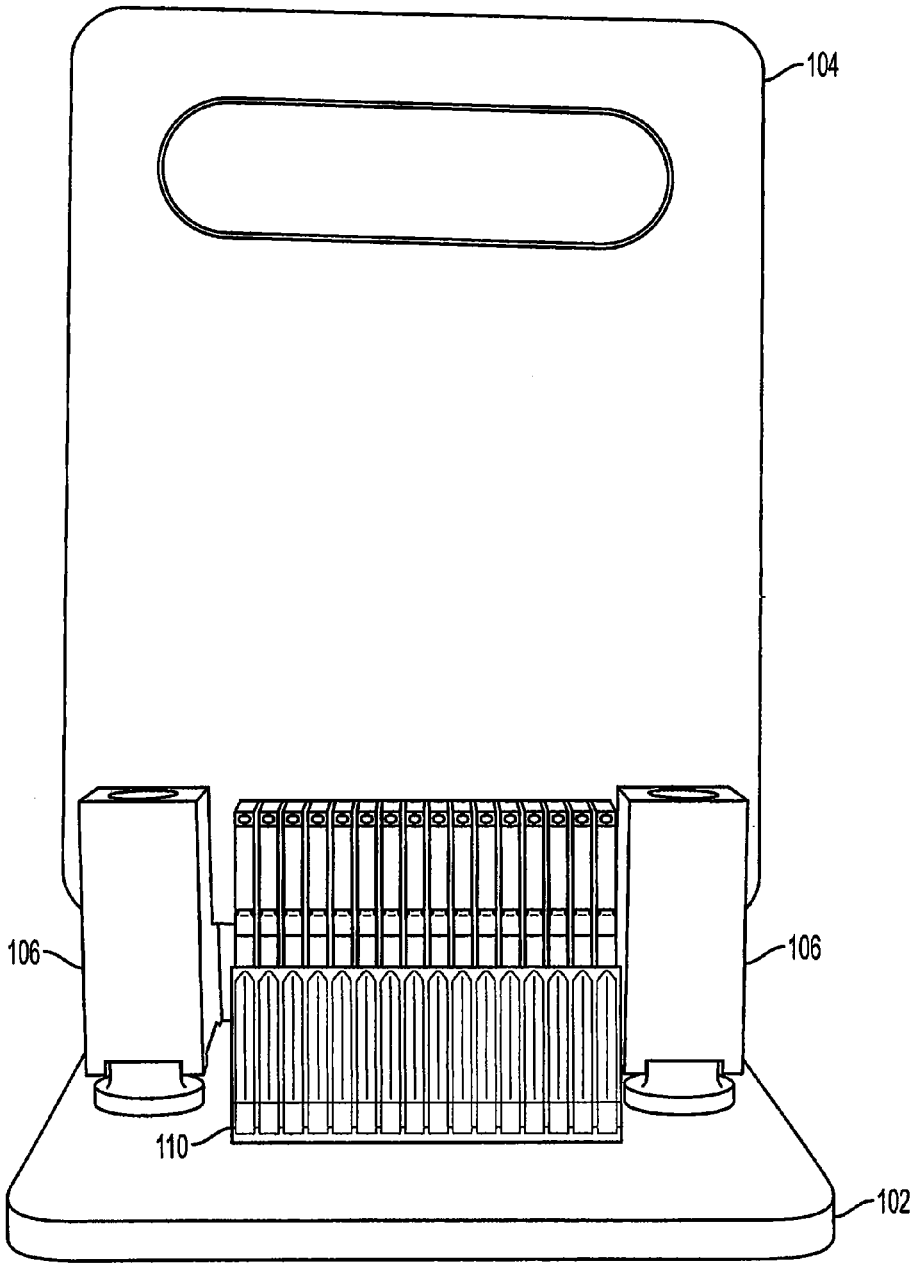
FIG. 1 shows a perspective front view of an interface system connecting a peripheral device board to a mother board according to an embodiment of the present invention.

FIG. 1 shows a perspective front view of an interface system 110 connecting a peripheral device board 104 to a mother board 102 according to an embodiment of the present invention. The mother board 102 (a.k.a. backplane board) may be a part of a high speed computer and/or server, which can host a processor for generating and receiving high speed communication signals. The mother board 102 may be a printed circuit board (PCB) and/or a printed wire board (PWB) that is configurable to support various processing devices. These processing devices may include, but are not limited to, a general purpose processor, a microprocessor, a field programmable gate array (FPGA), a 8641 single/dual power PC, and/or a Freescale® 8641 processor.

The peripheral device board (a.k.a. daughter board) 104 may be a PCB and/or a PWB, which may be used for supplying one or more peripheral electronic devices for the mother board 102. These peripheral electronic devices may include, but are not limited to, a random access memory device, a FLASH memory device, a read-only memory device, a sensing device, a video interface device, an audio interface device, a transceiver, a radar, and/or a sound navigation and ranging (SONAR) device.

The interface system 110 may be used for establishing an electrical connection between the mother board 102 and the peripheral device board 104. More specifically, the interface system 110 may allow high speed electronic signals and/or data to be communicated between the mother board 102 and the peripheral device board 104. In one embodiment, for example, the interface system 110 may transmit data at a rate ranging from about 3 GB per second to about 10 GB per second. In another embodiment, for example, the interface system 110 may transmit data at a rate of about 6 GB per second.

After the interface system 110 electrically connects the peripheral device board 104 to the mother board 102, a pair of mating locks 106 may be used for mechanically fastening the peripheral device board 104 to the mother board 102. The mother board 102 and the peripheral device board 104 can be designed to support various military and/or aerospace applications. These military and/or aerospace applications may be executed in various dynamic environments. As such, the mother board 102, the peripheral device board 104, and the components supported thereon may operate under a wide range of conditions, which may include severe vibrations, unpredictable shocks and/or a rapid change in temperature. In order to allow the mother board 102 and the peripheral device board 104 to perform in such harsh conditions, the interface system 110 may include various components to provide a steady and reliable connection between the mother board 102 and the peripheral device board 104.

Figure 2:
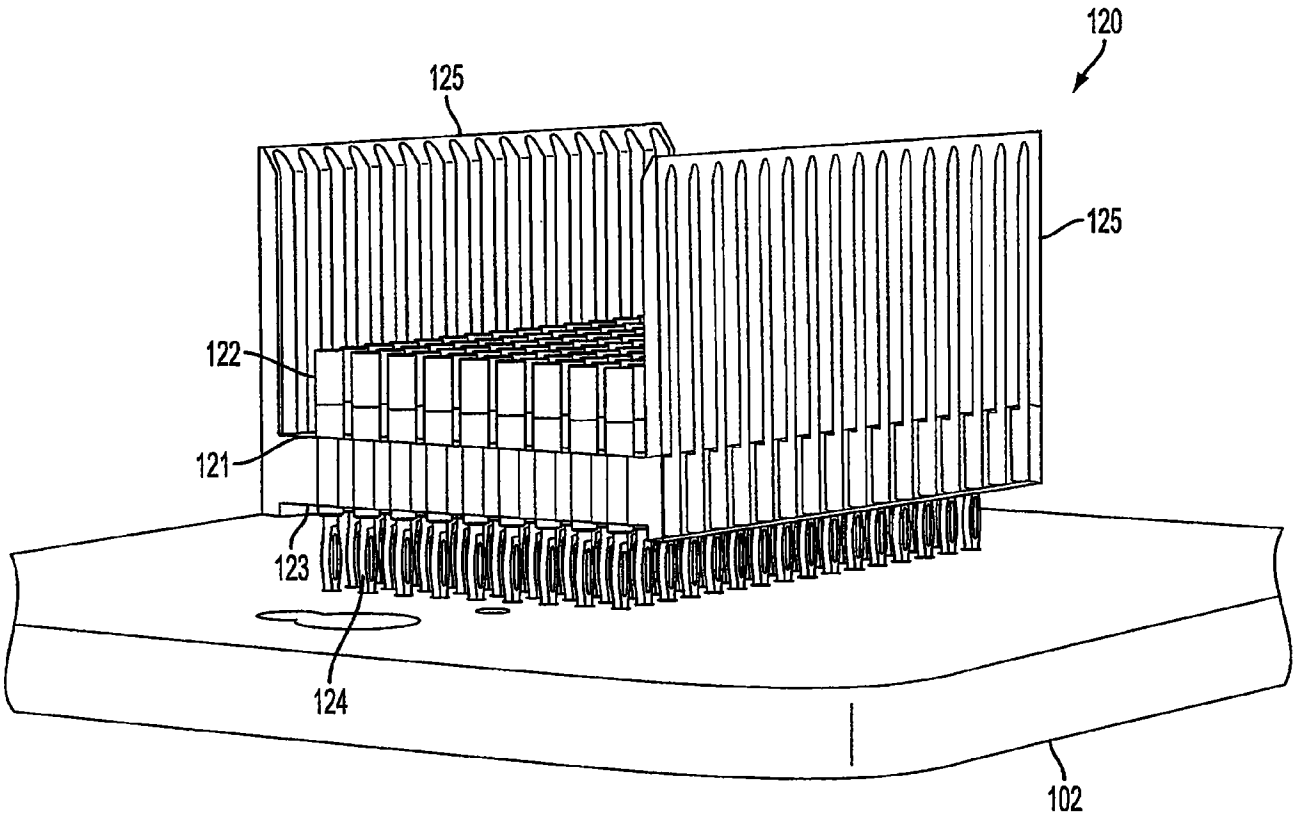
FIG. 2 shows a perspective view of a backplane interface connected to the mother board according to an embodiment of the present invention.

FIG. 2 shows a perspective view of a backplane interface 120 connected to the mother board 102 according to an embodiment of the present invention. The backplane (mother) interface 120 may be a part of the interface system 110, and it may be coupled to the mother board 102 to form a mother board subsystem. The backplane interface 120 may include a backplane interface surface 121, a backplane connecting surface 123, and a pair of backplane brackets 125. The backplane interface surface 121 may support a plurality of backplane interface sockets 122. The backplane connecting surface 123 may oppose the backplane interface surface 121, and it may support a plurality of backplane connecting pins 124. The backplane connecting pins 124 may be plugged into the mother board 102 when the backplane interface 120 is connected to the mother board 102.

When each of the backplane connecting pins 124 are properly situated within one of the sockets located on the mother board 102, the backplane connecting surface 123 may be facing towards the mother board 102 while the backplane interface surface 121 may be facing away from the mother board 102. The backplane brackets 125 may be erected perpendicularly to the backplane connecting surface 123 and/or the backplane interface surface 121. The backplane brackets 125 may be used for protecting a space immediately above and/or adjacent to the backplane interface sockets 122. Although FIG. 2 shows that a pair of backplane brackets 125 is used in the backplane interface 120, the backplane interface 120 may include one backplane bracket 125, three backplane brackets 125, and/or four backplane brackets 125 according to various embodiments of the present invention.

Figure 3:
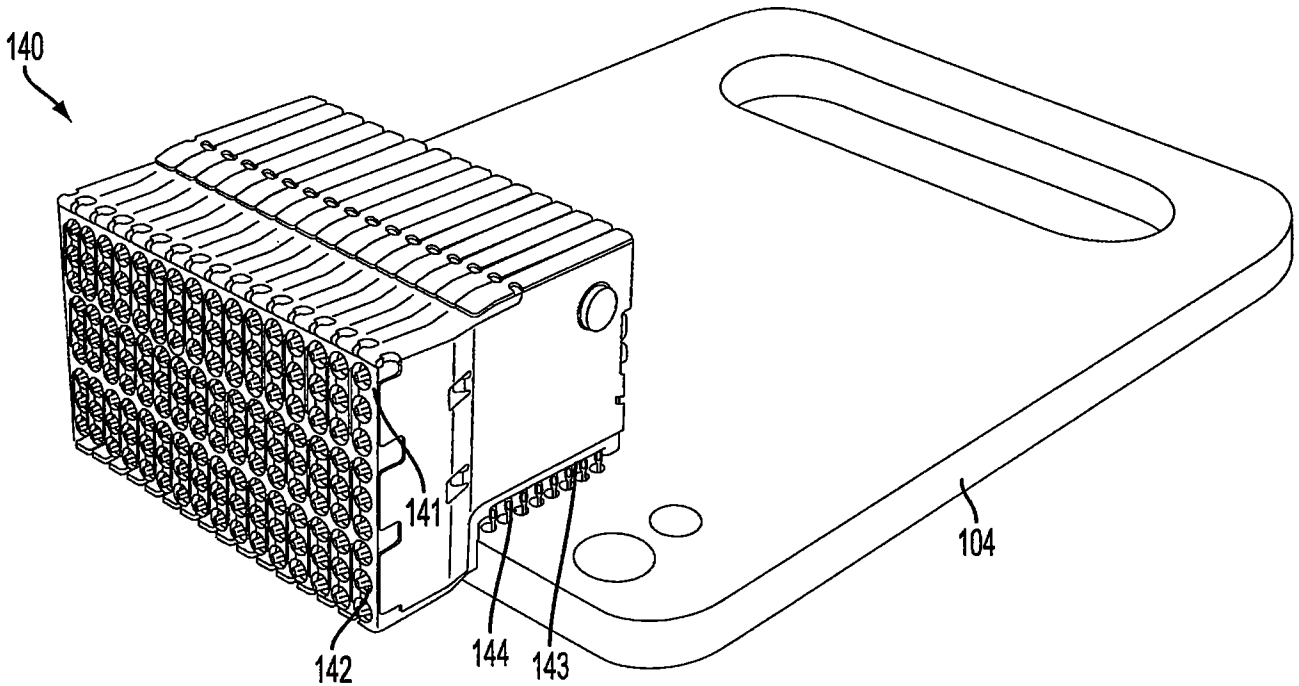
FIG. 3 shows a perspective view of a peripheral interface connected to the peripheral device board according to an embodiment of the present invention.

FIG. 3 shows a perspective view of a peripheral interface 140 connected to the peripheral device board 104 according to an embodiment of the present invention. The peripheral (daughter) interface 140 may be a part of the interface system 110, and it may be coupled to the peripheral device board 104 to form a daughter card subsystem. The peripheral interface 140 may include a peripheral interface surface 141 and a peripheral connecting surface 143. To allow optimal spacing between the mother board 102 and the peripheral device board 104, the peripheral connecting surface 143 may be positioned perpendicular to the peripheral interface surface 141.

The peripheral interface surface 141 may support a plurality of peripheral interface pins 142. The peripheral connecting surface 143 may support a plurality of peripheral connecting pins 144. The peripheral connecting pins 144 may be plugged into the peripheral device board 104 when the peripheral interface 140 is connected to the peripheral device board 104.

Figure 4:
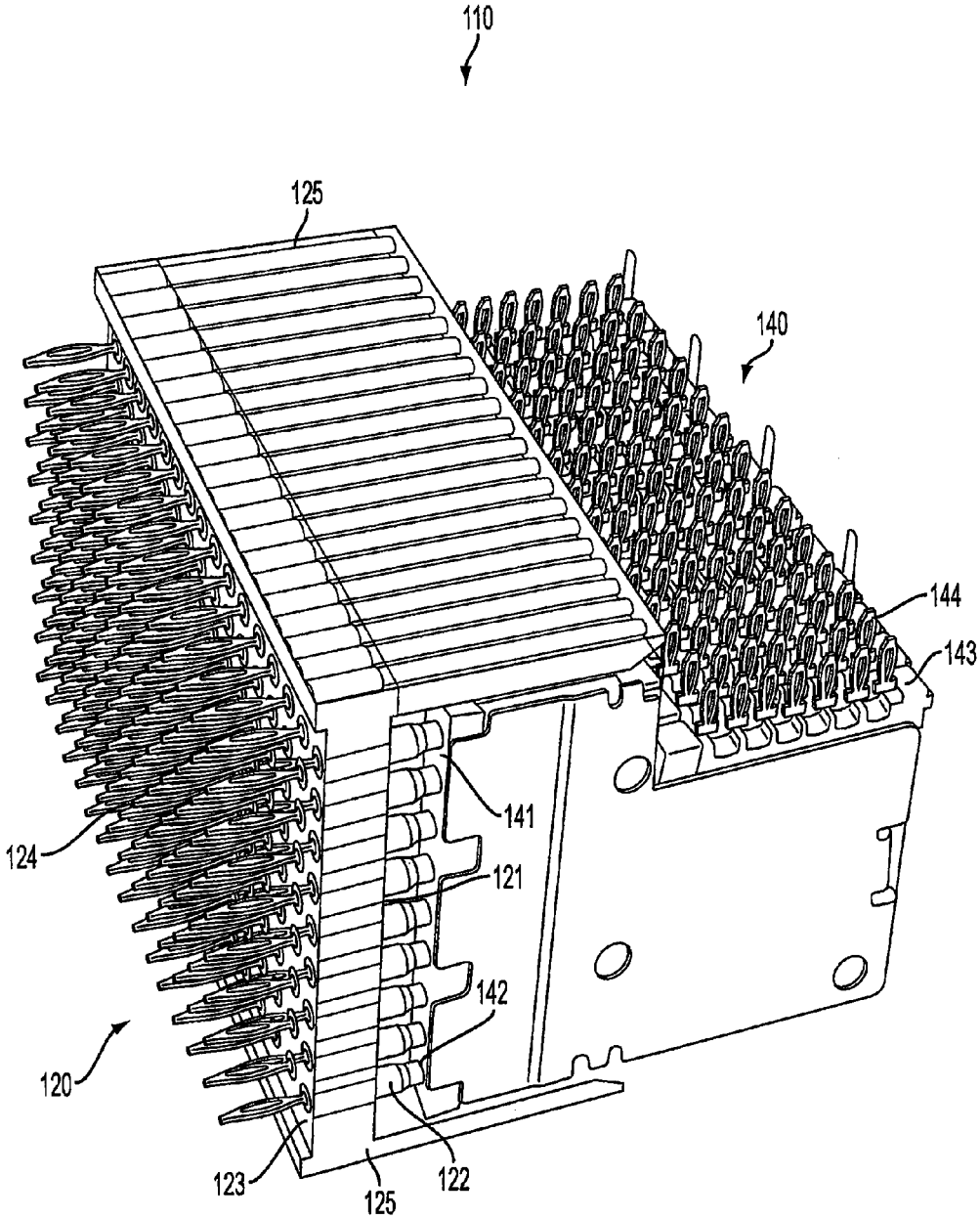
FIG. 4 shows a perspective side view of the interface system according to an embodiment of the present invention.

FIG. 4 shows a perspective side view of the interface system 110 according to an embodiment of the present invention. The peripheral interface 140 may mate with the backplane interface 120. Specifically, the plurality of peripheral interface pins 142 may be inserted into the plurality of backplane interface sockets 122. When the peripheral interface 140 is mated with the backplane interface 120, the backplane interface surface 121 may be facing the peripheral interface surface 141. Consequently, the backplane interface surface 121, as well as the backplane connecting surface 123, may be arranged perpendicularly to the peripheral connecting surface 143.

When the peripheral interface 140 is mated with the backplane interface 120, the pair of backplane brackets 125 may protect the connection between the peripheral interface pins 142 and the backplane interface sockets 122. In order to establish a reliable and steady electrical connection between the peripheral interface 140 and the backplane interface 120, the inner surface of each of the backplane interface sockets 122 may assert multiple contact forces against the outer surface of each of the peripheral interface pins 142. The multiple contact forces may be asserted along multiple contact lines and at multiple angles, each of which may be perpendicular to a core axis of the corresponding peripheral interface pin 142. Accordingly, each of the backplane interface sockets 122 may provide tight control on insertion force and extraction force. Such tight control may facilitate smooth and light wiping action across the contact surfaces between the backplane interface sockets 122 and the peripheral interface pins 142. As a result, the wear and damages of the backplane interface sockets 122 and the peripheral interface pins 142 may be minimized.

Figure 5:
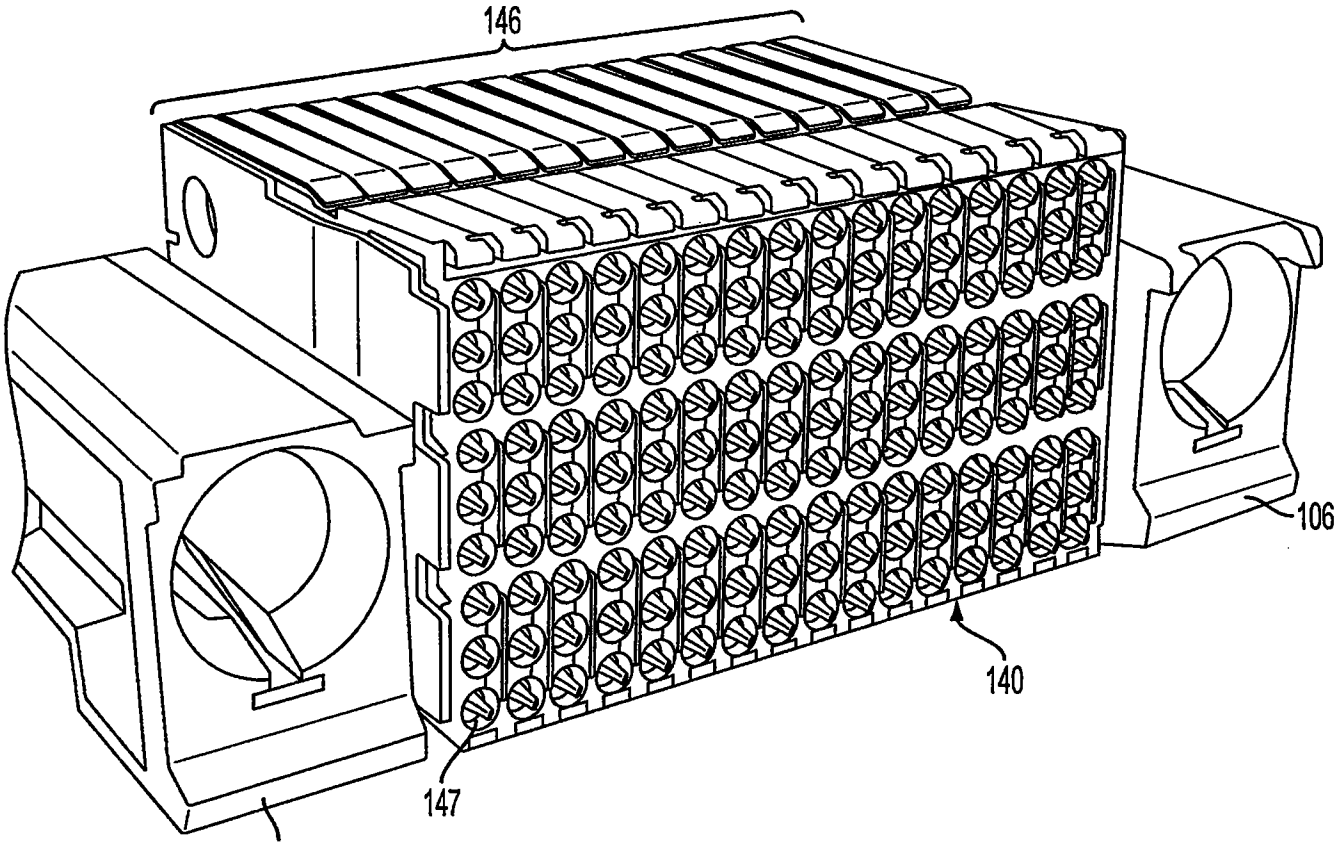
FIG. 5 shows a perspective view of the peripheral interface with a plurality of guide ports according to an embodiment of the present invention.

FIG. 5 shows a perspective view of the peripheral interface 140 with a plurality of guide ports 147 according to an embodiment of the present invention. The plurality of guide ports 147 may be positioned adjacent to or in front of the peripheral interface surface 141 of the peripheral interface 140. The plurality of guide ports 147 may be used for guiding and stabilizing the coupling between each of the peripheral interface pins 142 and each of the backplane interface sockets 122. Specifically, each of the backplane interface sockets 122 may fit into one of the guide ports 147. As such, the relative movement between the backplane interface sockets 122 and the peripheral interface pins 142 can be minimized when the backplane interface 120 and/or the peripheral interface 140 experience external shocks and vibrations.

The peripheral interface 140 may be a single device or it can be modularized. In one embodiment, for example, the peripheral interface 140 may include a plurality of wafer modules (wafers) 146. Each of the wafers 146 may be connected to a column of the peripheral interface pins 142 and a column of the peripheral connecting pins 144. Each of the wafers 146 may be replaced, repaired, and/or removed. Additional wafers 146 may be added to the peripheral interface 140. As such, the peripheral interface 140 may be adjustable to meet the I/O configurations of various types of mother boards and peripheral device boards.

Figure 6:
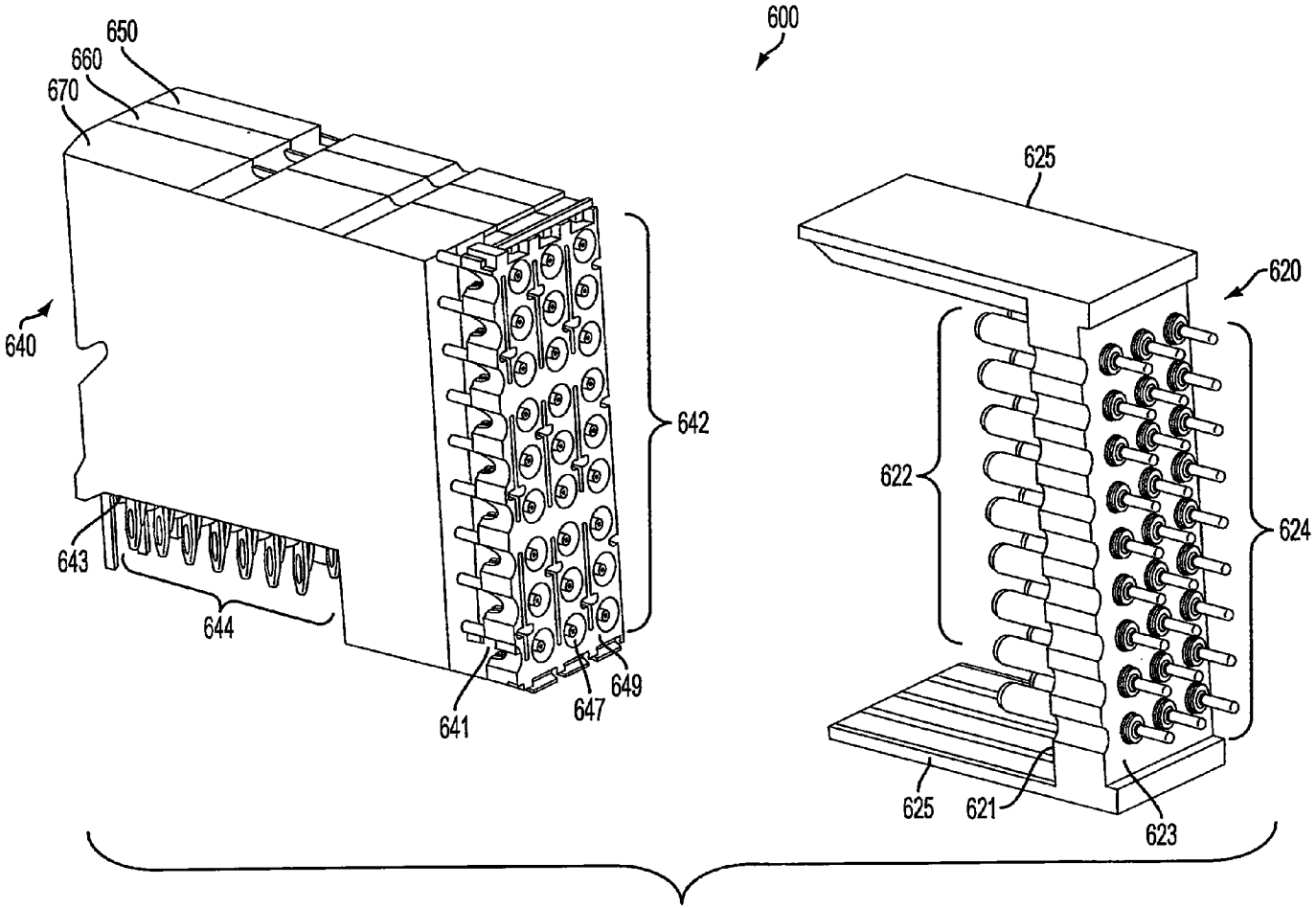
FIG. 6 shows a perspective view of an interface system according to an embodiment of the present invention.
Figure 7:
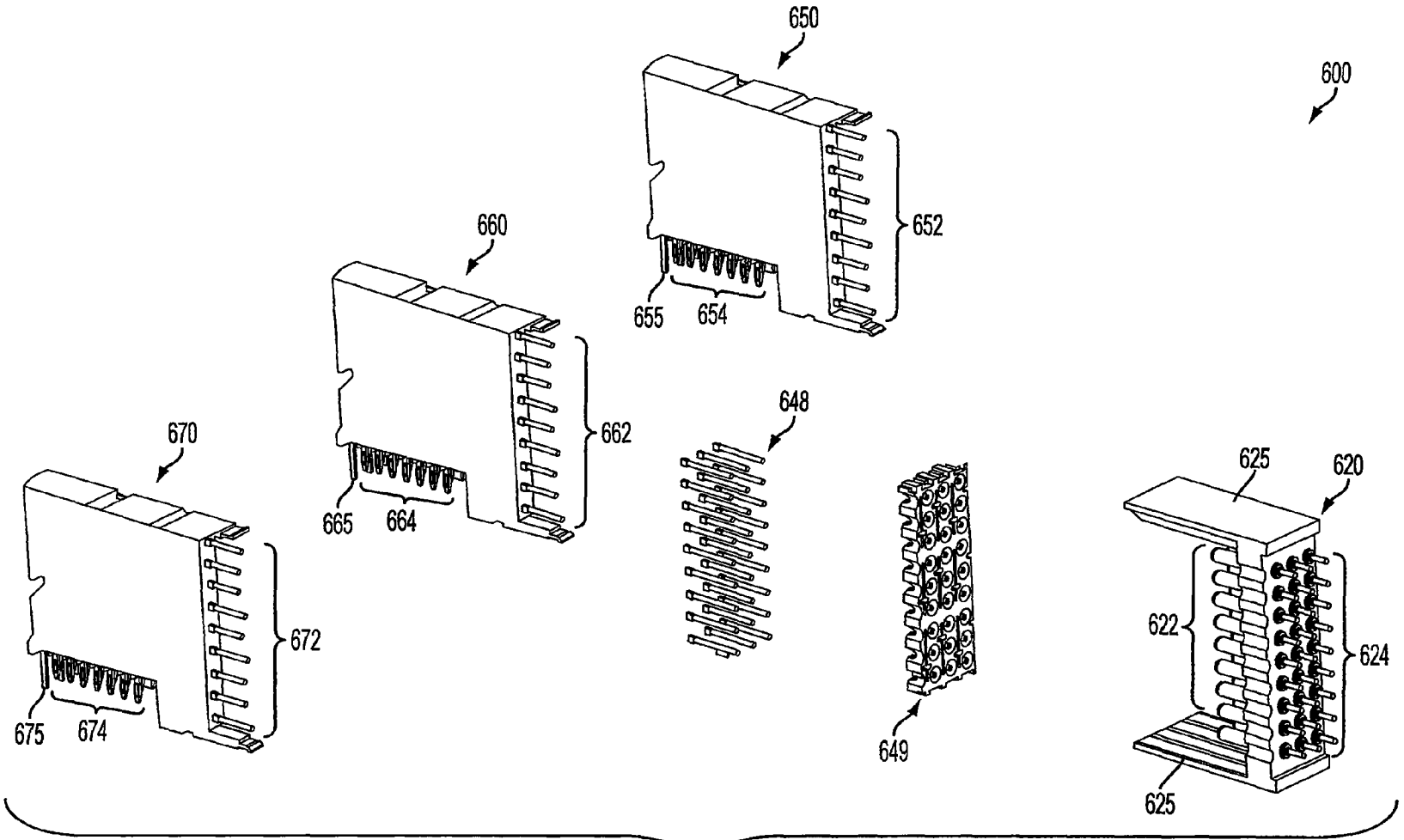
FIG. 7 shows an exploded view of the interface system according to an embodiment of the present invention.

FIGS. 6-7 show a perspective view and an exploded view of an interface system 600 according to an embodiment of the present invention. The interface system 600 may have similar functional and/or structural features as the interface system 110. As such, the interface system 600 may be adapted, reconfigured, and/or modified to perform the functions of the interface system 110. The interface system 600 may include a mother interface 620 and a daughter interface 640. The mother interface 620 may be coupled to a main system board, such as the mother board 102. The daughter interface 640 may be coupled to a peripheral system board, such as the peripheral device board 104. The interface system 600 may provide a flexible coupling between the main system board and one or more peripheral system boards. The interface system 600 may operate in harsh military and/or aerospace environments, which may include severe vibrations, severe shocks, and/or extreme temperature ranges.

The mother interface 620 may have similar features as the backplane interface 120. For example, the mother interface 620 may include a mother interface surface 621 and a mother connecting surface 623. The mother interface surface 621 may face the daughter interface 640, and it may support a plurality of mother interface sockets 622. In one embodiment, each of the mother interface sockets 622 may be gold plated for enhancing the conductivity thereof.

The mother connecting surface 623 may face the main system board, and it may support a plurality of mother connecting pins 624. The mother connecting pins 624 may be inserted into the main system board such that the mother interface 620 can be electrically coupled to the main system board. Optionally, the mother interface 620 may include a pair of mother brackets 625 for protecting a space defined therebetween. The mother interface 620 may include an insulating material to arrange the plurality of mother interface sockets 622 in such a way that they are spaced evenly from one another. In one embodiment, for example, the insulating material may arrange the plurality of mother interface sockets 622 into a 3-by-9 array.

The daughter interface 640 may include a first wafer 650, a second wafer 660, and a third wafer 670, each of which may be ruggedized to provide structural protection for the connection between the main system board and the peripheral system board. In one embodiment, for example, each of the first, second, and third wafers 650, 660, and 670 may have a tin-plated metal housing. The first wafer 650 may include a first column 652 of daughter interface pins 642, a first column 654 of daughter connecting pins 644, and a first daughter connecting ground pin 655. The second wafer 660 may include a second column 662 of daughter interface pins 642, a second column 664 of daughter connecting pins 644, and a second daughter connecting ground pin 665. The third wafer 670 may include a third column 672 of daughter interface pins 642, a third column 674 of daughter connecting pins 644, and a third daughter connecting ground pin 675.

When being stacked against one another, the first, second, and third wafers 650, 660, and 670 may define a daughter interface surface 641 and a daughter connecting surface 643. To maximize the spatial efficiency of the interface system 600, the daughter interface surface 641 may be arranged perpendicularly to the daughter connecting surface 643. The plurality of daughter interface pins 642 may be arranged to form a 3-by-9 array on the daughter interface surface 641. The array of daughter interface pins 642 may match with and received by the 3-by-9 array of mother interface sockets 622.

In one embodiment, each of the daughter interface pins 642 may be made of a nickel material with a gold-plated surface 648. In another embodiment, each of the daughter connecting pins 644 may be made of a gold plated metal. In yet another embodiment, each of the first, second and third daughter connecting ground pin 655, 665, and 675 may be made of polished steel.

The daughter interface 640 may include a guide mount 649 for serving various functions. In one scenario, for example, the guide mount 649 may align the daughter interface surface 641 with the mother interface surface 621. In another scenario, for example, the guide mount 649 may secure the daughter interface 640 to the mother interface 620 by pushing against the mother interface surface 621 and the pair of mother brackets 625. In yet another scenario, for example, the guide mount 649 may define a plurality of guide ports 647 for guiding the connection between the daughter interface pins 642 and the mother interface sockets 622.

Moreover, the guide ports 647 may be used for stabilizing the connected pin-socket pairs such that each of the mother interface sockets 622 may have a limited or insignificant movement in relative to the corresponding daughter interface pin 642. Specifically, each of the plurality of guide ports 647 may surround one of the plurality of daughter interface pins 642 in such a way that one mother interface socket 622 may fit within a space defined between the daughter interface pin 642 and the guide port 647. In such manner, the daughter interface 640 may cooperate with the mother interface 620 to provide a ruggedized structure for interfacing a main system board with a peripheral system board.

Figure 8:
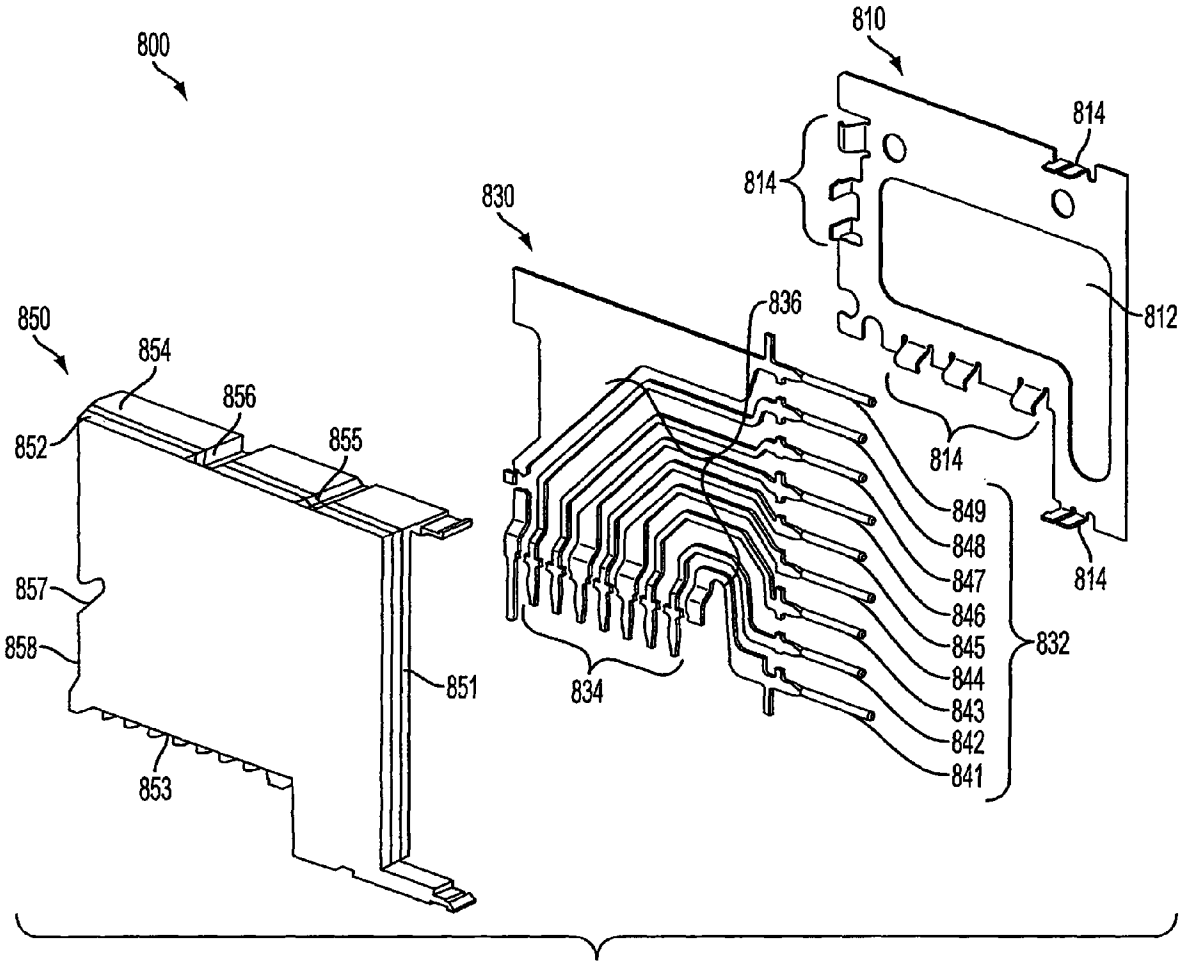
FIG. 8 shows an exploded view of a wafer according to an embodiment of the present invention.

FIG. 8 shows an exploded view of a wafer 800 according to an embodiment of the present invention. The wafer 800 may be used for implementing, but without limiting, the functional and structural features of the first wafer 650, the second wafer 660, and/or the third wafer 670. The wafer 800 may include a shielding plane 810, a signal frame 830, and a wafer housing 850.

The wafer housing 850 may be used for protecting the shielding plane 810 and the signal frame 830. The wafer housing 850 may include a first shell 852 and a second shell 854. The first shell 852 may join the second shell 854 for defining a compartment within which the shielding plane 810 and the signal frame 830 may be held. The edges of the first shell 852 and the second shell may be combined to form an interface surface 851 and a connecting surface 853.

The interface surface 851 may be facing a backplane interface, such as the backplane interface 120 and/or the mother interface 620. The connecting surface 853 may be facing a peripheral device board, such as the peripheral device board 104. In one embodiment, the interface surface 851 may be perpendicular to the connecting surface 853. Optionally, the first shell 852 and the second shell 854 may define several slot pairs, such as a first slot pair 855, a second slot pair 856, a third slot pair 857, and a fourth slot pair 858. Each of the first slot pair 855, the second slot pair 856, the third slot pair 857, and the fourth slot pair 858 may provide an air passage to the compartment.

The first shell 852 and the second shell 854 may each be made of a ruggedized material. In one embodiment, for example, the first shell 852 and the second shell 854 may each be made of a tinplated metal. In another embodiment, for example, the first shell 852 and the second shell 854 may each be made of a hard plastic material. In yet another embodiment, for example, the first shell 852 and the second shell 854 may each be made of liquid crystal polymer with tinplated metallic side surfaces.

The shielding plane 810 may define an aperture 812 and include several security clips 814. The aperture 812 may allow air to flow through one or more slot pair (e.g., the first, second, third, and fourth slot pairs 855, 856, 857, and 858). The security clips 814 may be used for mounting the shielding plane 810 in between the first shell 852 and the second shell 854. The shielding plane 810 may be made of an insulating material, such that it may be used for shielding the signal plane 830 from electromagnetic interference. In one embodiment, for example, the shielding plane 810 may be made of liquid crystal polymer.

The signal plane 830 may include nine signal traces 836. Each of the nine signal traces 836 may be coupled between one of the interface pins 832 and one of the connecting pins 834. The interface pins 832 may protrude from the interface surface 851, while the connecting pins 834 may protrude from the connecting surface 853. As such, the interface pins 832 may be perpendicular to the connecting pins 834 when the interface surface 851 is perpendicular to the connecting surface 853. The interface pins 832 may receive and/or transmit two or more pairs of differential signals. Each pair of differential signals may be shielded by one or more ground signals. In one embodiment, for example, the interface pins 832 may include a first interface pin 841, a second interface pin 842, a third interface pin 843, a fourth interface pin 844, a fifth interface pin 845, a sixth interface pin 846, a seventh interface pin 847, a eighth interface pin 848, and a ninth interface pin 849. To minimize fringing effect, each of the nine traces 836 may be bent at an obtuse angle for one or more times. In one embodiment, the signal plane 830 may be made of lead.

Figure 9A:
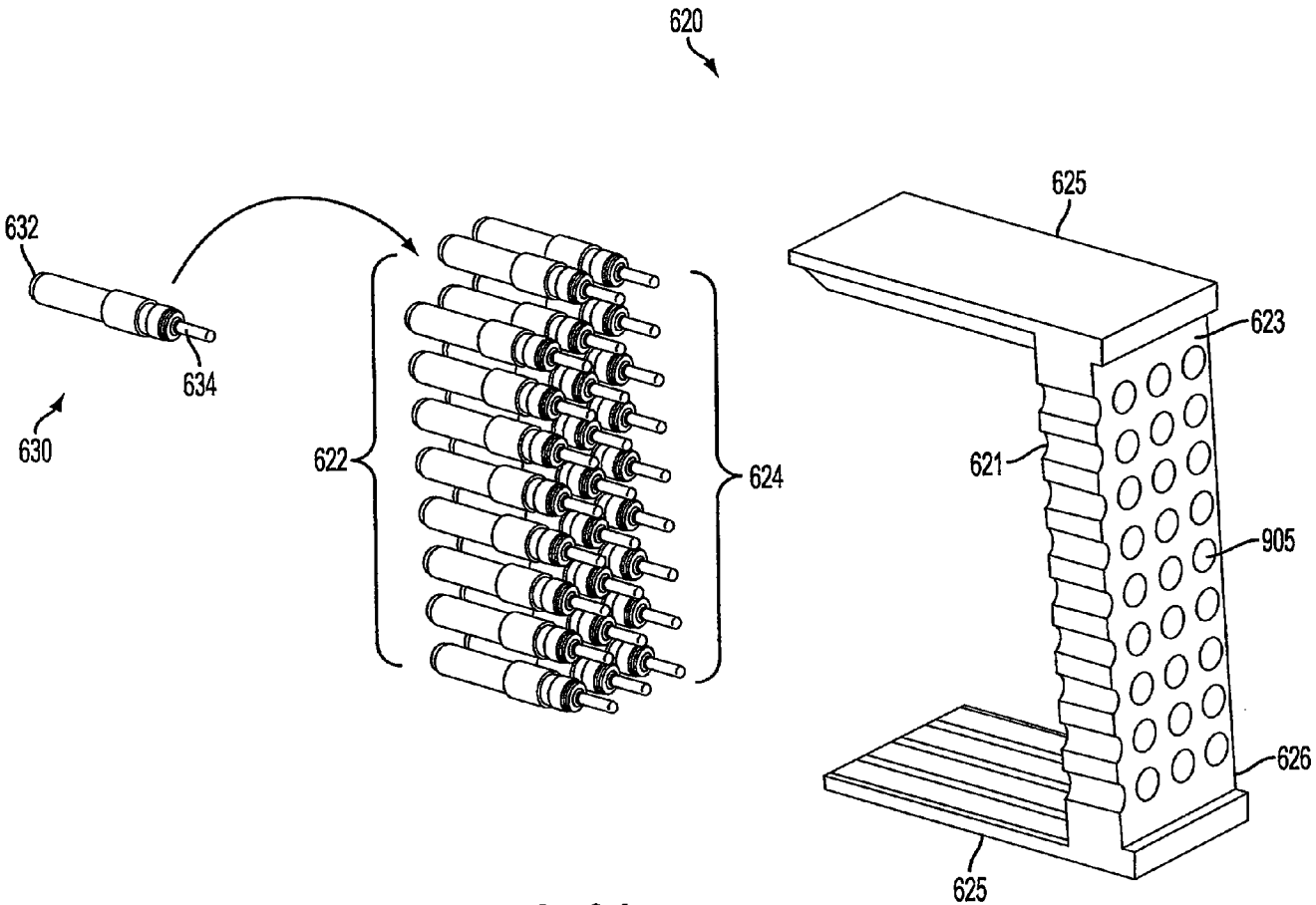
FIG. 9A shows an exploded view of a mother interface according to an embodiment of the present invention.

FIG. 9A shows an exploded view of a mother interface 620 according to an embodiment of the present invention. The mother interface 620 may include a platform 626, which may be connected to the pair of mother brackets 625 to form a U-Shaped member. When the mother interface 620 is coupled to the daughter interface 640, the U-Shaped member may reduce and/or minimize the relative movement between the daughter interface 640 and the mother interface 620. Accordingly, the U-Shaped member may fortify the mechanical and electrical couplings between the daughter interface pins 642 and the mother interface sockets 622.

The platform 626 may include a plurality of ports 905 for holding a plurality of hybrid units 630. The plurality of ports 905 may be of various shapes or sizes in order to accommodate varying shapes or sizes of the plurality of hybrid units 630. The hybrid units 630 may snap into the ports 905 and thus be secured with the platform 626. Alternatively, the hybrid units may be fastened within the ports 905 via other methods, for example by adhesives. Each of the hybrid units 630 may include a socket end 632 and a pin end 634. The socket end 632 may be used for implementing the mother interface socket 622, and the pin end 634 may be used for implementing the mother connecting pin 624. In one embodiment, the socket end 632 may be electrically coupled with the pin end 634. In another embodiment, the socket end 632 may be mechanically coupled to or decoupled from the pin end 634.

When the hybrid unit 630 is stationed in the port 905 of the platform 626, the pin end 634 may protrude from the mother connecting surface 623, while the socket end 632 may protrude from the mother interface surface 621. The platform 626 may arrange the hybrid units 630 to match a pattern of the daughter interface pins 642 and/or the pin configurations of the main system board. In one embodiment, for example, the platform 626 may arrange the hybrid units 630 to form a 3-by-9 array.

Figure 9B:
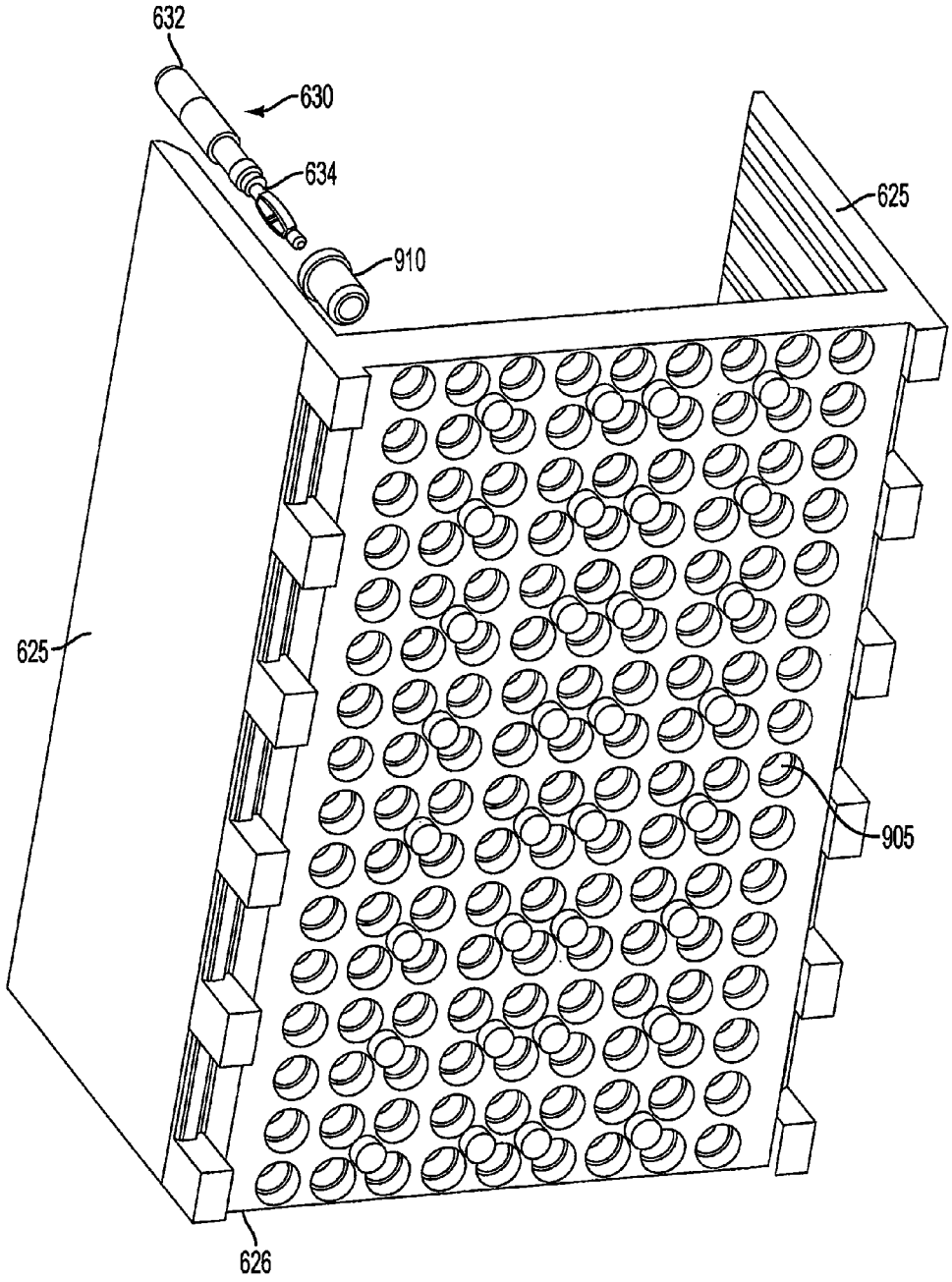
FIG. 9B shows an exploded view of a mother interface according to an embodiment of the present invention.

Varying characteristic impedances of the mother interface 620 or the entire connector may be obtained by altering the geometry or configuration of the plurality of hybrid units 630. Electrical impedance is a quantifiable parameter of a signal path and can depend upon the actual geometry or sizing of conductors forming a portion of the signal path. Insulators, including air, positioned adjacent to the conductors can also impact the electrical impedance as determined by the insulator's dielectric constant. FIG. 9B shows an expanded, perspective view of an alternative embodiment of a mother interface incorporating a hybrid unit 630 with a socket end 632 having a reduced diameter, for example, a diameter of 0.75-0.80 mm. Altering the diameter of the socket end 632 may result in varying, and in some cases advantageous, electrical impedance. The socket end 632 may be designed to have any diameter as required to meet electrical requirements or system specifications.

Figure 9C:
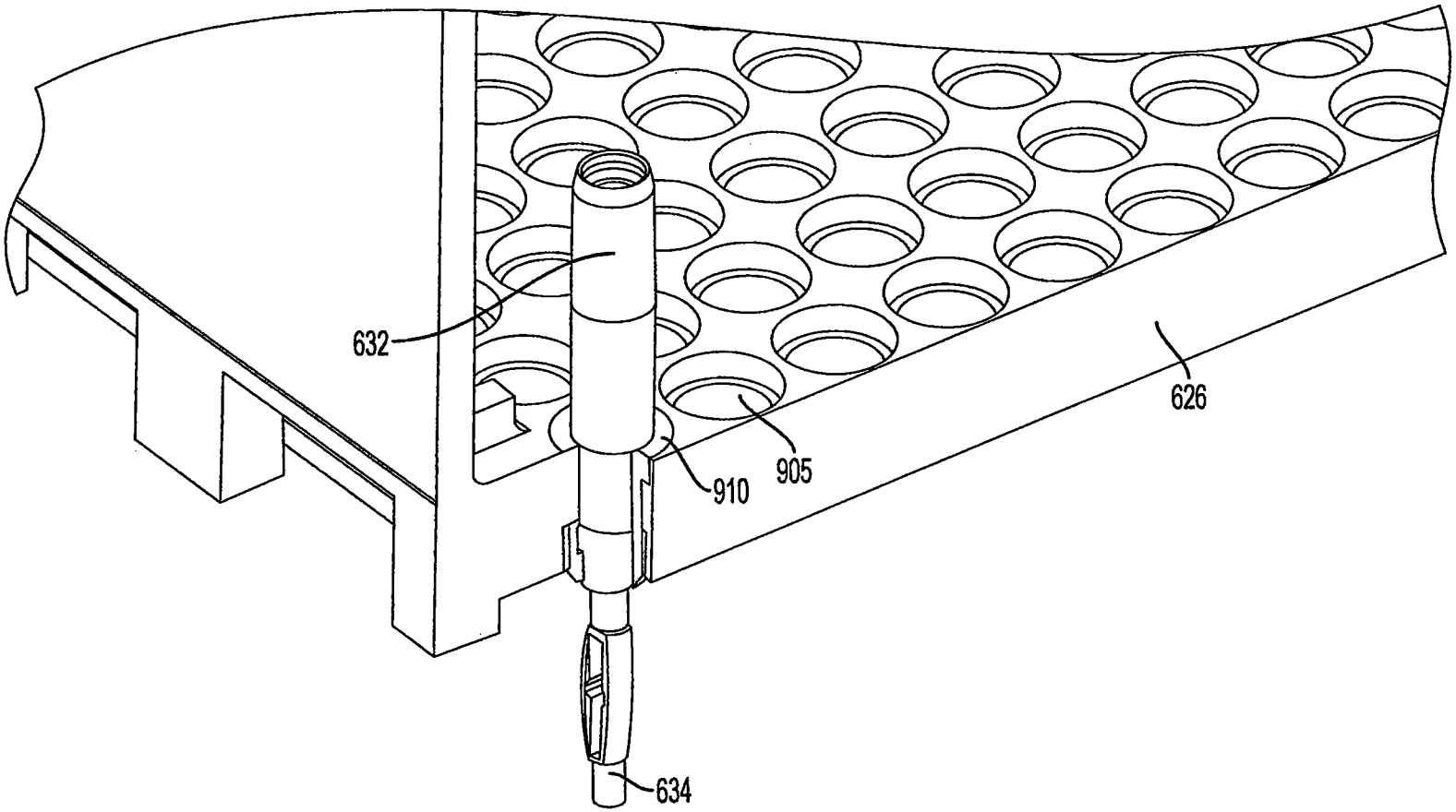
FIG. 9C shows a zoomed perspective view of a mother interface according to an embodiment of the present invention.

With certain geometries or sizes of the hybrid unit 630, an intermediate spacer 910 may be used to surround the hybrid unit 630 and/or facilitate the coupling of the hybrid unit 630 within one of the ports 905 of the platform 626. For example, at some socket diameters, the hybrid unit 630 may be too small in size to easily snap into one of the ports 905. The intermediate spacer 910 may thus be used to surround the hybrid unit 630 and provide a larger diameter. A portion of the hybrid unit 630 may fit within an inner diameter of the intermediate spacer 910 and both the intermediate spacer 910 and the hybrid unit 630 may secure within one of the ports 905 of the platform 626. FIG. 9C shows the hybrid unit 630 and the intermediate spacer 910 inserted within one of the plurality of ports 905 of a mother interface platform 626.

The intermediate spacer 910 may be pliable or flexible in nature and act as a snap or retention element for holding the hybrid unit 630 in the port 905. The intermediate spacer 910 may be shaped with various geometries and made of various materials to aid in the overall impedance of the signal path. One method of tuning the overall impedance of the signal path may thus be accomplished by utilizing different materials (e.g. different plastics) with different dielectric constants for the intermediate spacer 910. For example, the intermediate spacer 910 may be manufactured out of a Teflon (PTFE) material and/or have a dielectric constant of 2. With reference to FIG. 9A, when the hybrid unit 630 and the intermediate spacer 910 are stationed in one of the ports 905, the pin end 634 of the hybrid unit may extend from the mother connector surface 623 while the socket end 632 of the hybrid unit may extend from the mother interface surface 621. In an alternative embodiment, other socket or pin connector elements may interface with the intermediate spacer 910 in place of or in addition to the hybrid unit 630. Another method of tuning the overall impedance of the signal path may thus be accomplished by altering the geometry or structural configuration (e.g. size and/or length) of the mating connection with the socket end 632 of the hybrid unit in order to introduce greater or reduced air adjacent to such mating connection.

Figure 10A:
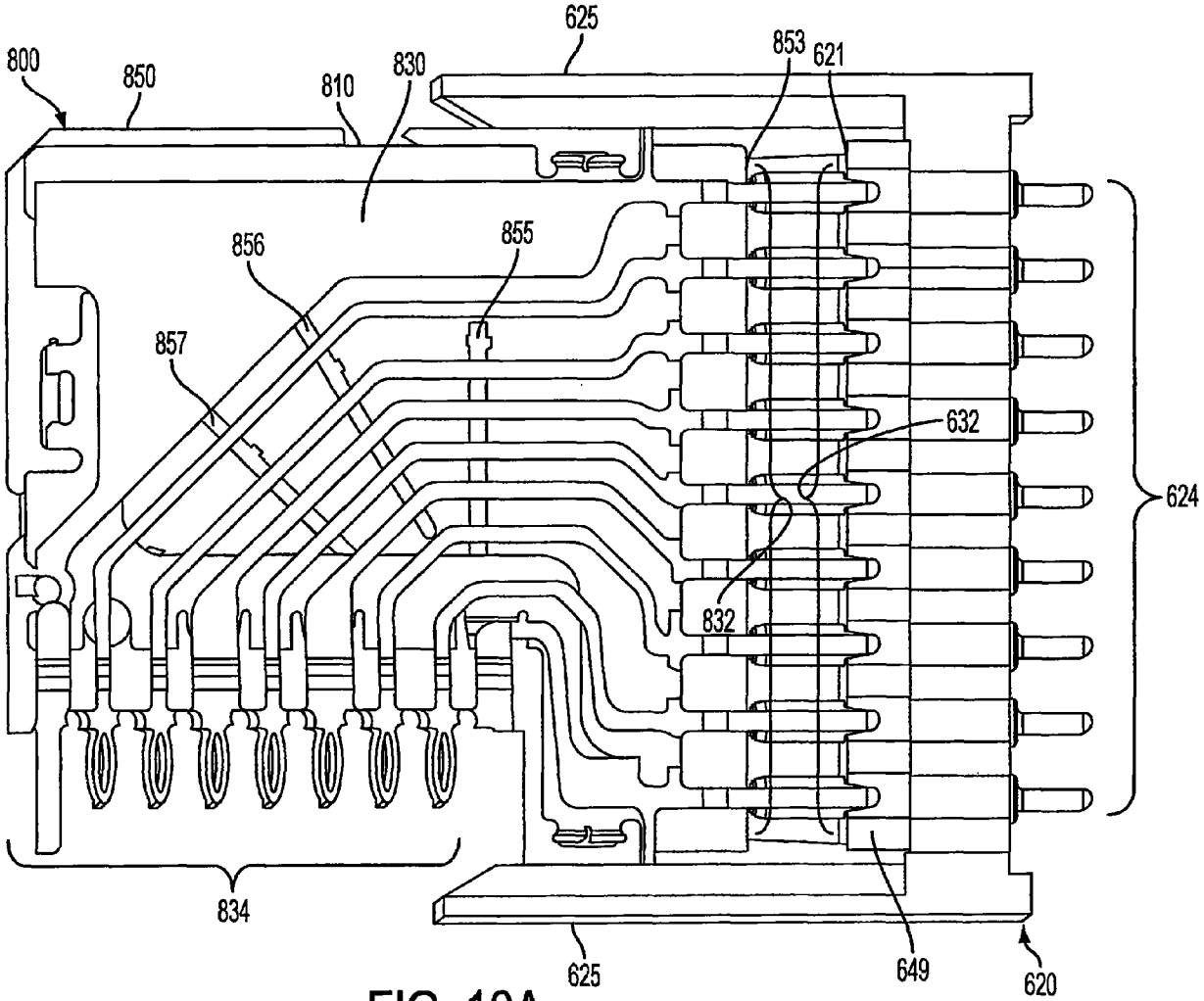
FIG. 10A shows a cross-sectional view of a wafer connected to the mother interface according to an embodiment of the present invention.

FIG. 10A shows a cross-sectional view of the wafer 800 connected to the mother interface 620 according to an embodiment of the present invention. The interface surface 853 of the wafer housing 850 may be enclosed by the U-Shaped member of the mother interface 620. The guide mount 649 may be mechanically coupled to the socket ends 632 of the hybrid units 630. In return, the socket ends 632 may encapsulate the interface pins 832. As a result, the guide mount 649 may cooperate with the U-Shaped member of the mother interface 620 to stabilize and fortify the connection between the interface pins 832 and the socket ends 632. The overall characteristic impedance of the signal path along the wafer 800 and/or the mother interface 620 may be tunable via various geometric configurations or through the selection of various materials.

The connecting pins 834 may be perpendicular to the mother connecting pins 624. The connecting pins 834 may face towards the peripheral system board, such as the peripheral device board 104. The mother connecting pins 624 may face towards the main system board, such as the mother board 102. As such, the interface system, which may include the wafer 800 and the mother interface 620, may position the main system board to be perpendicular to the peripheral system board.

Figure 10B:
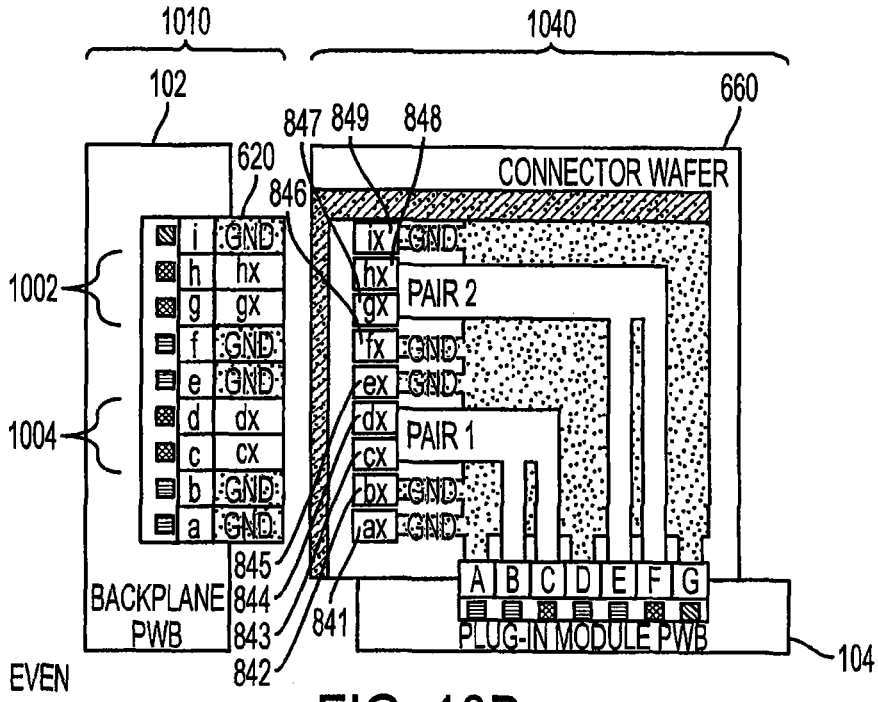
FIG. 10B shows a first interface configuration according to an embodiment of the present invention.

FIG. 10B shows a first (even) interface configuration according to an embodiment of the present invention. The first interface configuration may include a mother board subsystem 1010 and a daughter card subsystem 1040. The mother board subsystem 1010 may include the mother interface 620 and the mother board 102, which can be a backplane PWB. The daughter card subsystem 1040 may include the second wafer (daughter interface) 660 and the peripheral device board 104, which can be a plug-in module PWB. The mother board subsystem 1010 and the daughter card subsystem 1040 may directly communicate with each other.

The communication between the mother board subsystem 1010 and the daughter card subsystem 1040 may rely on one or more pairs of differential signals, such as the differential pair 1004 and the differential pair 1002. In the first configuration, the differential pair 1004 may be transmitted via the third interface pin 843 and the fourth interface pin 844, while the differential pair 1002 may be transmitted via the seventh interface pin 847 and the eighth interface pin 848. In order to provide high speed transmission with low noise and little interference, the two differential pairs 1004 and 1002 may be shielded and separated by one or more ground signal traces. The ground signal traces may be connected to the first interface pin 841, the second interface pin 842, the fifth signal pin 845, the sixth signal pin 846, and the ninth signal pin 849.

Figure 10C:
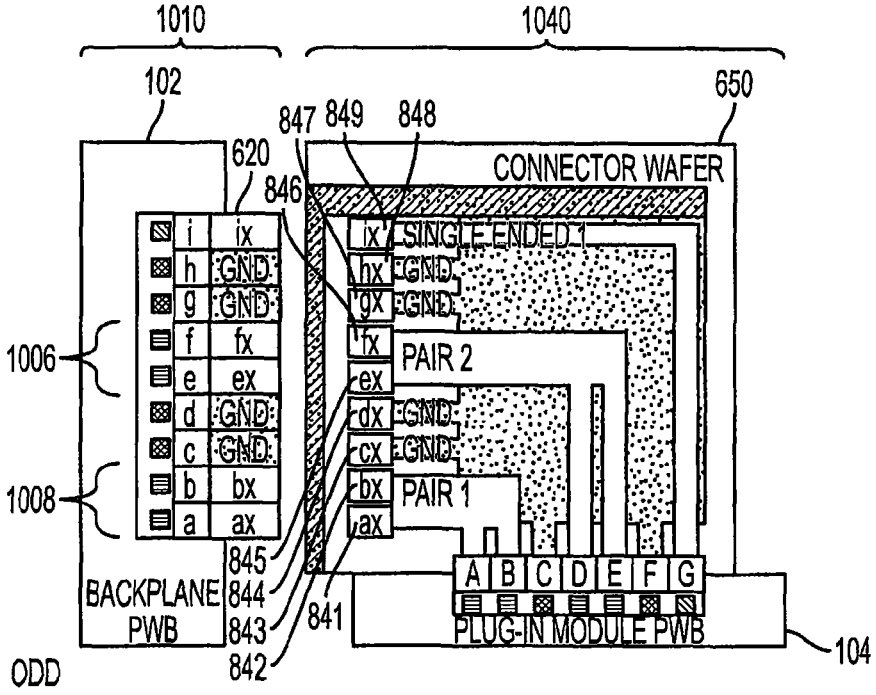
FIG. 10C shows a second interface configuration according to an embodiment of the present invention.

FIG. 10C shows a second (odd) interface configuration according to an embodiment of the present invention. The second interface configuration may be similar to the first interface configuration except that the first wafer (daughter interface) 650 may replace the second wafer 660. Within the first wafer 650, the differential pair 1008 and the differential pair 1006 are transmitted by different interface pins. For example, the differential pair 1008 may be transmitted via the first interface pin 841 and the second interface pin 842, while the differential pair 1006 may be transmitted via the fifth interface pin 845 and the sixth interface pin 846. In order to provide high speed transmission with low noise and little interference, the two differential pairs 1008 and 1006 may be shielded and separated by one or more ground signal traces. The ground signal trances may be connected to the third interface pin 843, the fourth interface pin 844, the seventh interface pin 847, and the eighth interface pin 848.

In one embodiment, the even configuration (e.g., the second wafer 660) may interpose with the odd configuration (e.g., the first wafer 650) to form a three dimensional signal-ground interlay (3D-SGI) pattern. Within the 3D-SGI pattern, each differential pair signal may be surrounded by ground signals from at least three sides, such that each differential pair signal may be substantially isolated from other differential pair signals. The 3D-SGI pattern may further eliminate cross-talk and electromagnetic interference. As a result, the interface system may facilitate robust and reliable data transmission between the mother board subsystem 1010 and the daughter card subsystem 1040.

Figure 11:
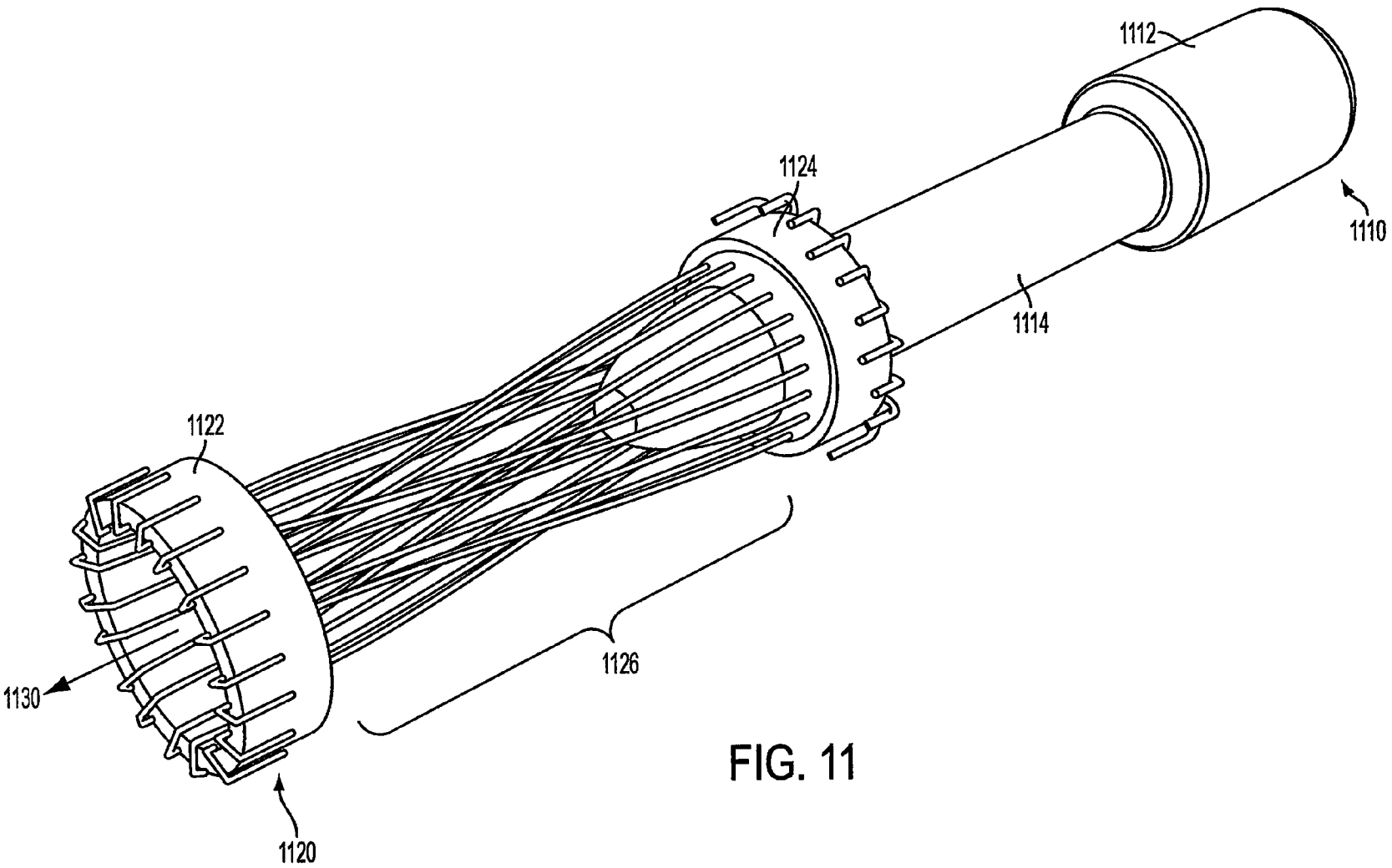
FIG. 11 shows a perspective view of a daughter interface pin entering a multi-contact socket according to an embodiment of the present invention.

FIG. 11 shows a perspective view of a daughter interface pin 1110 entering a multi-contact socket 1120 according to an embodiment of the present invention. The daughter interface pin 1110 may be used for implementing the interface pin 832, the daughter interface pin 642, and/or the peripheral interface pin 142. The multi-contact socket 1120 may be used for implementing the backplane interface socket 122 and/or the mother interface socket 622.

The daughter interface pin 1110 may include a pin base 1112 and a pin head 1114. In one embodiment, the pin base 1112 may be electrically coupled with the pin head 1114. In another embodiment, the pin base 1112 can be mechanically coupled to and/or decoupled from the pin head 1114. The pin base 1112 may be positioned within the wafer housing 850 and connected to one of the signal traces 836. The pin head 1114 may protrude from the interface surface 853 of the wafer housing 850.

The multi-contact socket 1120 may include a first socket ring 1122, a second socket ring 1124, and a socket wire sleeve 1126. The first socket ring 1122 and the second socket ring 1124 may define a common axis 1130. Along the common axis 1130, a cylindrical space may be partially enclosed by the first socket ring 1122 and the second socket 1124. The socket wire sleeve 1126 may be coupled between the first socket ring 1122 and the second socket ring 1124.

The socket wire sleeve 1126 may include a plurality of contact elements, such as a plurality of contact wires. Each of the contact elements may have a first end and a second end. The first end of the contact element may hook onto the first socket ring 1122, and the second end of the contact element may hook onto the second socket ring 1124. In one embodiment, for example, the number of contact elements may range from about 3 to about 24. In another embodiment, for example, the number of contact elements may range from about 4 to about 16. In yet another embodiment, for example, the socket wire sleeve 1126 may include 5 contact elements.

To refine the passage defined by the socket wire sleeve 1126, the first socket ring 1122 may be angularly displaced in relative to the second socket ring 1124. In such a manner, the plurality of contact elements may be partially twisted to form a helicoidal mesh surface. The helicoidal mesh surface may be flexible, and it may have a shape of an hour glass. Generally, the helicoidal mesh surface may be positioned within the cylindrical space defined by the first socket ring 1122 and the second socket ring 1124.

Figure 12A:
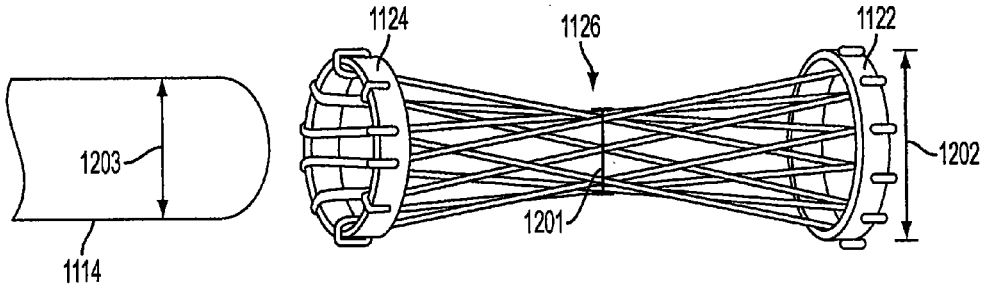
FIGS. 12A-12C show the perspective views of the multi-contact socket interacting with the daughter interface pin according to an embodiment of the present invention.
Figure 12B:
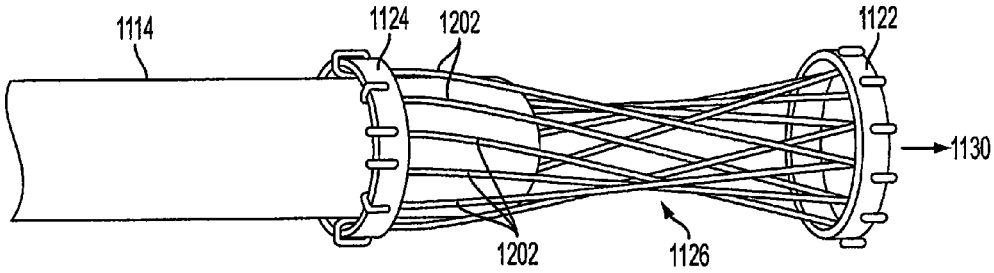
Figure 12C:
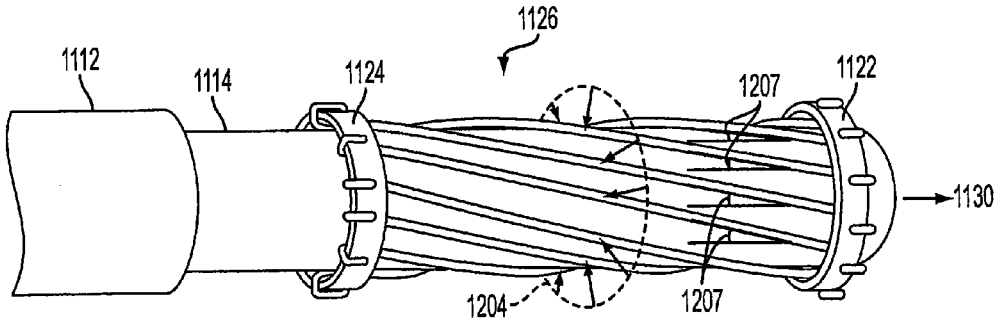

FIGS. 12A-12C show the perspective views of the multi-contact socket 1120 interacting with the daughter interface pin 1110 according to an embodiment of the present invention. Referring to FIG. 12A, the socket wire sleeve 1126 may include a middle section, which may have a first diameter 1201 before the daughter interface pin 1110 is inserted into the multi-contact socket 1120. In order to receive the pin head 1114 of the daughter interface pin 1110, at least one of the first socket ring 1122 or the second socket ring 1124 may have a second diameter (ring diameter) 1202, which may be greater than a third diameter (pin diameter) 1203 of the pin head 1114.

In one embodiment, for example, the first diameter 1201 may be substantially smaller than the third diameter 1203. In another embodiment, for example, a ratio of the first diameter 1201 over the third diameter 1203 may range from about 0.3 to about 1. In another embodiment, for example, a ratio of the first diameter 1201 over the third diameter 1203 may range from about 0.5 to about 0.9. In yet another embodiment, for example, a ratio of the first diameter 1201 over the third diameter 1203 may range from about 0.6 to about 0.8.

Referring to FIG. 12B, the pin head 1114 may establish multiple contact points 1202 with the socket wire sleeve 1126 as the pin head 1114 enters one of the first socket ring 1122 or the second socket ring 1124. Specifically, the pin head 1114 may stretch the inner surface of the helicoidal mesh, thereby causing the first diameter 1201 to expand. In return, each of the contact elements may assert a normal force against the surface of the pin head 1114. Each of the normal forces may be a resultant of a reaction force and a tension caused by the stretching of the helicoidal mesh (e.g., one or more of the contact wires). The normal forces may be perpendicular to the common axis 1130, and they may be distributed evenly and radially along the surface of the pin head 1114.

Referring to FIG. 12C, the pin head 1114 may establish multiple line contacts (contact lines) with the socket wire sleeve 1126 once the pin head 1114 is substantially inserted into the socket wire sleeve 1126. Along the cylindrical space defined by the first socket ring 1122 and the second socket ring 1124, the socket wire sleeve 1126 may assert multiple sets of radial force 1204 against the surface of the inserted pin head 1114. Each set of radial force 1204 may include a ring of normal forces directing towards a center of a circular path. As the contact elements are angularly extended between the first socket ring 1122 and the second socket ring 1124, the sets of radial force 1204 may provide a 360-degree grip on the inserted pin head 1114. The 360-degree grip may ensure that the pin head 1114 may remain in good electrical contact with the socket wire sleeve 1126 even when the interface system is under tremendous mechanical shock. Accordingly, the 360-degree grip may facilitate a reliable and durable coupling between the mother board (e.g., the backplane board 102) and the daughter board (e.g., the peripheral device board 104).

Moreover, the 360-degree grip may have an angular gradation 1207 for allowing smooth insertion and extraction of the pin head 1114. The angular gradation 1207 may provide smooth and light wiping action during pin insertion and/or extraction. In one embodiment, the angular gradation 1207 may range, for example, from about 0 degree to about 60 degrees. In another embodiment, the angular gradation 1207 may range, for example, from about 10 degrees to about 45 degrees. In yet another embodiment, for example, the angular gradation may range, for example, from about 15 degree to about 30 degrees.

Advantageously, the angular gradation 1207 may minimize the wear and damage to the contact surfaces of the pin head 1114 and the socket wire sleeve 1126. Such wear and damage minimization may help maintain the performance of the interface system for use in harsh military and/or aerospace environment. Specifically, the interface system may achieve a low insertion loss for data signals with a transmission rate that ranges from about 3 GHz to about 10 GHz. In one embodiment, for example, the interface system may achieve an insertion loss of −1.5 dB when the data signal is transmitted at 3 GHz. In another embodiment, for example, the interface system may achieve an insertion loss of −2 dB when the data signal is transmitted at 5 GHz. In yet another embodiment, for example, the interface system may achieve an insertion loss of −5 dB when the data signal is transmitted at 10 GHz.

Figure 13:
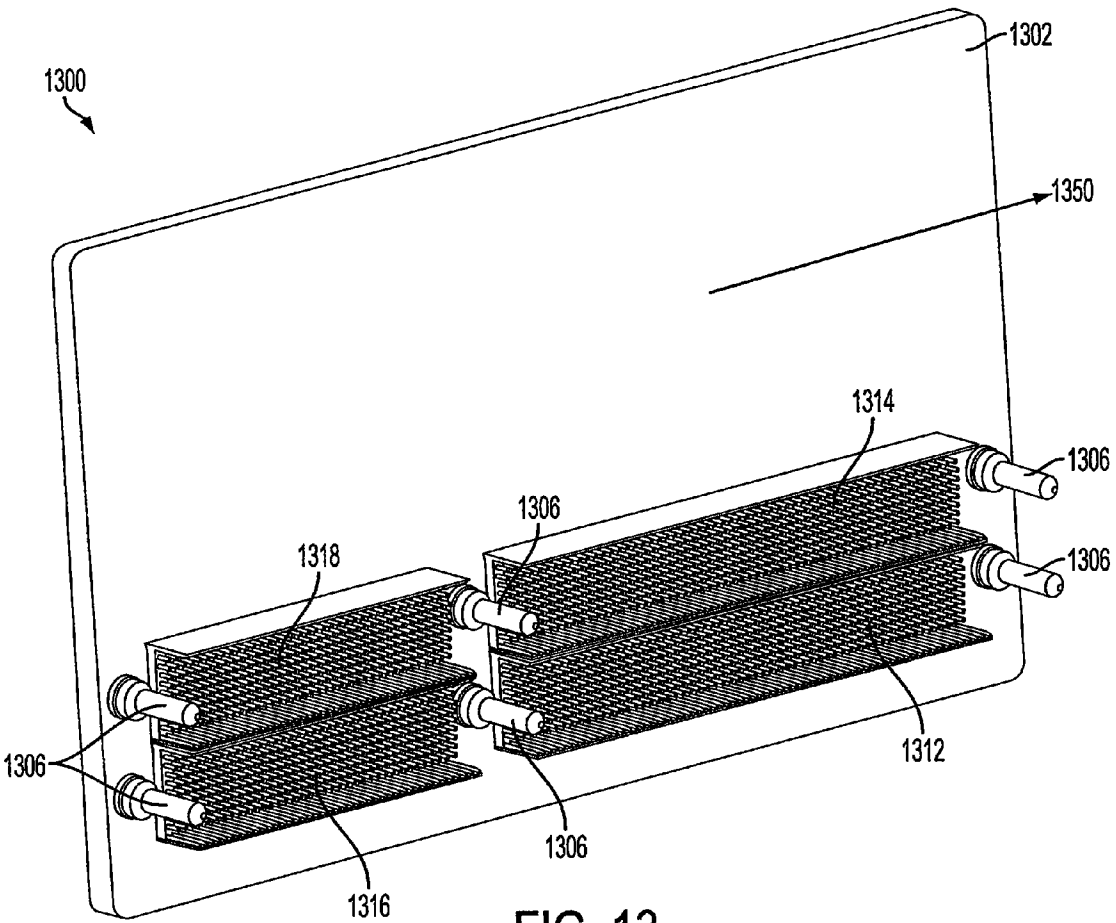
FIG. 13 shows a perspective view of a mother board subsystem according to an embodiment of the present invention.

FIG. 13 shows a perspective view of a mother board subsystem 1300 according to an embodiment of the present invention. The mother board subsystem 1300 may have characteristics that are consistent with the characteristics of the mother board subsystem 1010 as shown in FIGS. 10B and 10C. For example, the mother board subsystem 1300 may include a mother board 1302 and a plurality of mother interfaces, such as a first mother interface 1312, a second mother interface 1314, a third mother interface 1316, and a fourth mother interface 1318. The mother board 1302 may define a first plane 1350. Each of the mother interfaces (e.g., the first, second, third, and/or fourth mother interface 1312, 1314, 1316, and/or 1318) may have similar functional and structural features as the mother interface 620 as shown in FIGS. 6 and 9A. As such, the mother interfaces may be used for receiving various types of peripheral devices, each of which may be equipped with a daughter interface.

The mother interfaces may have various columns of interface sockets. In one embodiment, for example, the first mother interface 1312 and the second mother interface 1314 may each include 16 columns of interface sockets. In another embodiment, for example, the third mother interface 1316 and the fourth interface 1318 may each include 8 columns of interface sockets.

Depending on the configuration of the mother board 1302, the number of interface sockets along each column may vary. In one configuration, for example, each column may include 9 interface sockets, each of which may conduct about 1 Amp of current. Accordingly, the first mother interface 1312 and the second mother interface 1314 may each have 144 interface sockets, while the third mother interface 1316 and the fourth interface 1318 may each include 72 interface sockets.

Optionally, the mother board subsystem 1300 may include several male lock members 1306 positioned at both ends of each mother interface (e.g., the first, second, third, and/or fourth mother interface 1312, 1314, 1316, and/or 1318). The male lock members 1306 may be silver plated, and they may be used for mechanically securing one or more peripheral device boards.

Figure 14:
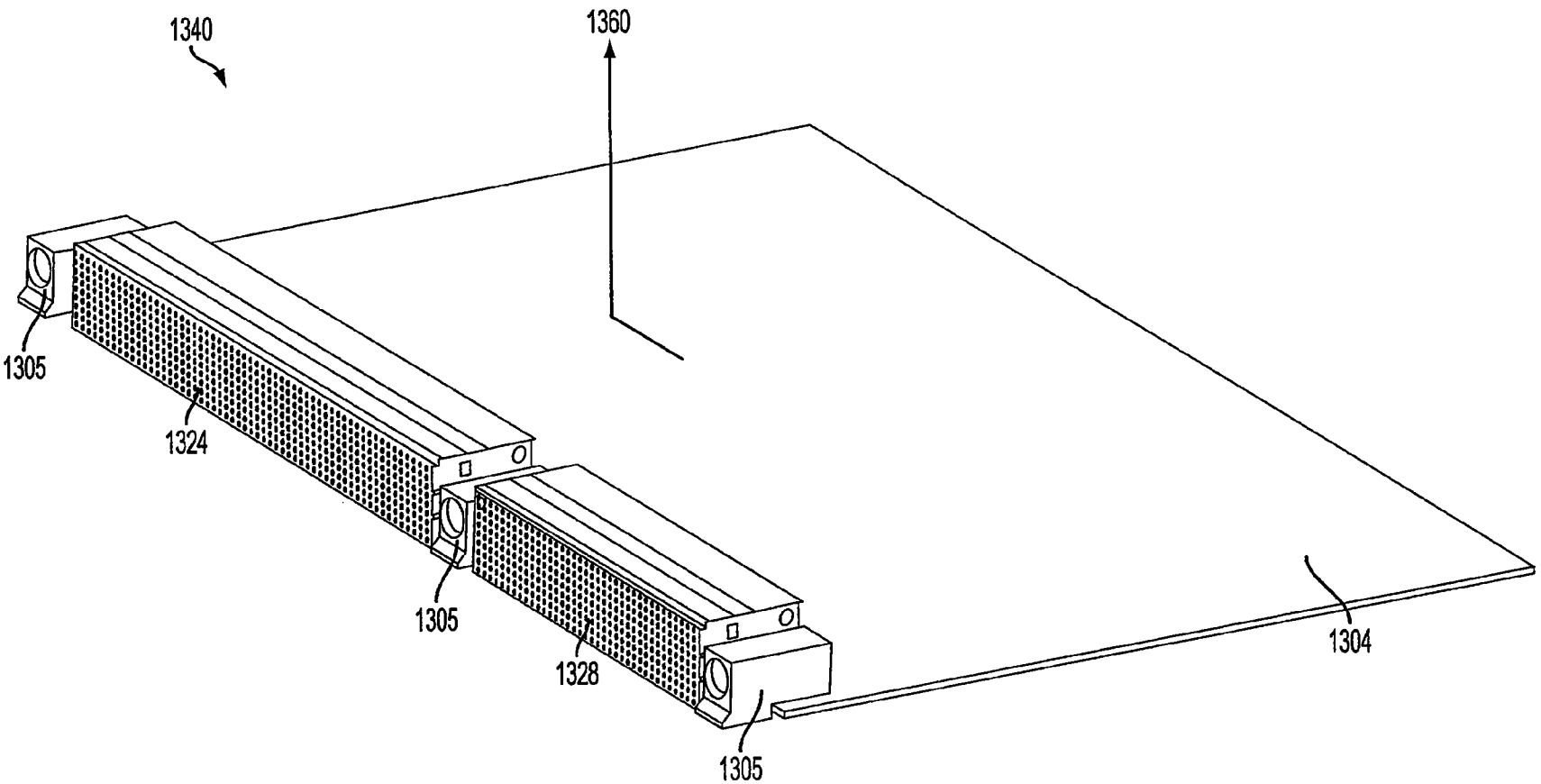
FIG. 14 shows a perspective view of a daughter card subsystem according to an embodiment of the present invention.

FIG. 14 shows a perspective view of a daughter card subsystem 1340 according to an embodiment of the present invention. The daughter card subsystem 1340 may have characteristics that are consistent with the characteristics of the daughter card subsystem 1040 as shown in FIGS. 10B and 10C. For example, the daughter card subsystem 1340 may include a (first) peripheral device board 1304 and a plurality of daughter interfaces, such as a first daughter interface 1324 and a second daughter interface 1328. The peripheral device board 1304 may define a second plane 1360. Each of the daughter interfaces (e.g., the first and second daughter interface 1324 and 1328) may have similar functional and structural features as the daughter interface 640 as shown in FIG. 6. As such, the daughter interfaces may be used for connecting the peripheral device board 1304 to one of the mother interfaces of the mother board subsystem 1300.

The daughter interfaces may have different columns of interface pins. In one embodiment, for example, the first daughter interface 1324 may include 16 columns of interface pins. In another embodiment, for example, the second daughter interface 1328 may include 8 columns of interface pins. Each of the columns may be implemented by the wafer 800 as shown in FIG. 8.

Depending on the configuration of the target mother interface, the number of interface pins along each column may vary. In one configuration, for example, each column may include 9 interface pins, each of which may conduct about 1 Amp of current. As such, the first daughter interface 1324 may have 144 interface pins, and the second daughter interface 1328 may have 72 interface pins.

Optionally, the daughter card subsystem 1340 may include several female lock members 1305 positioned at both ends of each daughter interface (e.g., the first and/or second daughter interface 1324 and/or 1328). The female lock members 1305 may be silver plated, and they may be used for mechanically securing the target mother board 1302. The application of the female lock members 1305 and the male lock members 1306 is interchangeable. In an alternative embodiment, for example, the male lock members 1306 may be installed on the peripheral device board 1304, while the female lock members 1305 may be installed on the mother board 1302.

Figure 15:
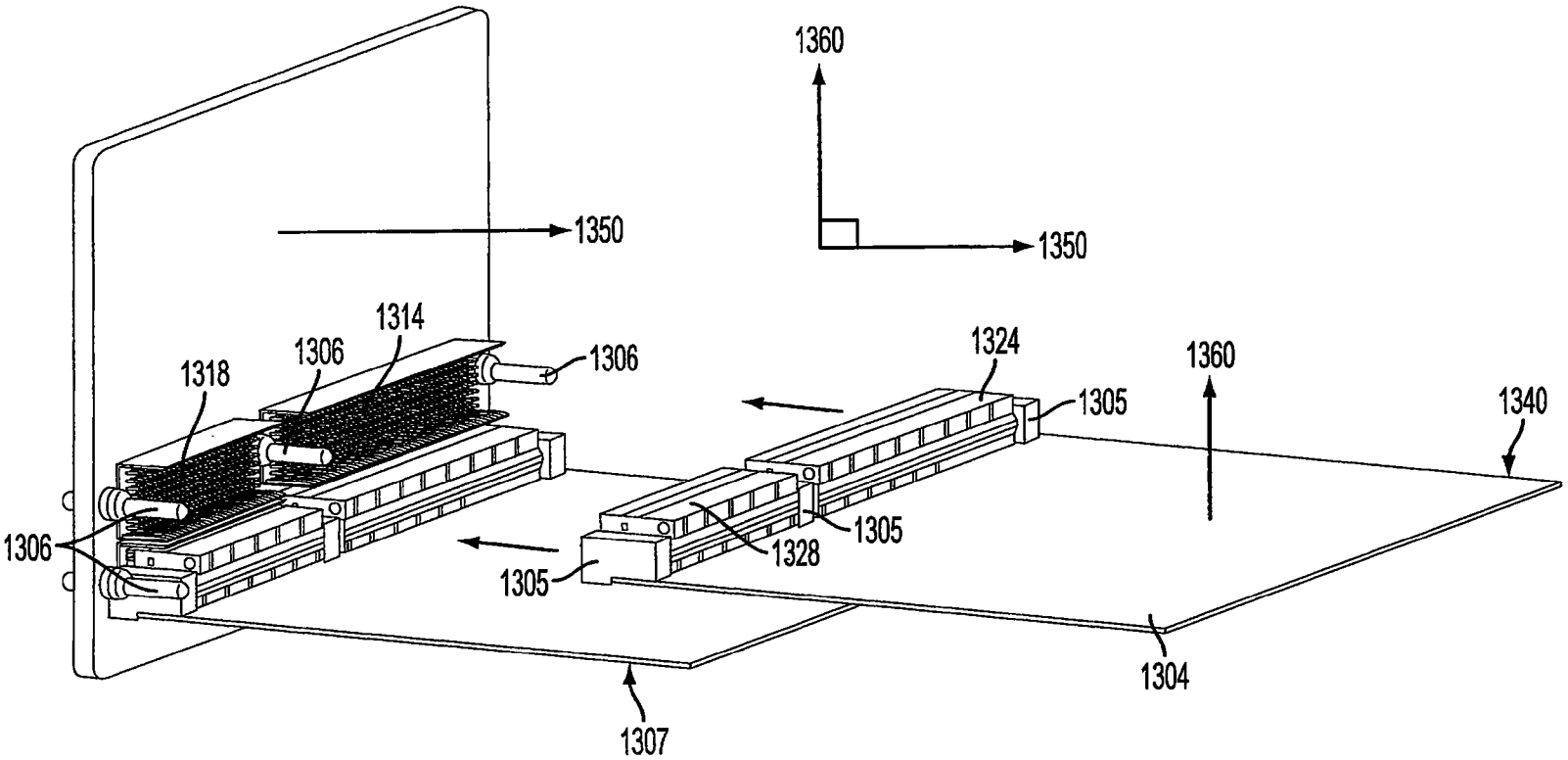
FIG. 15 shows a perspective view of the daughter card subsystem mating with a mother board subsystem.

FIG. 15 shows a perspective view of the daughter card subsystem 1340 mating with a mother board subsystem 1300. The mother interfaces (e.g., the first, second, third, and/or fourth mother interface 1312, 1314, 1316, and/or 1318) may allow the mother board subsystem 1300 to be connected with one or more daughter card subsystems, such as the first daughter card subsystem 1340 and a second daughter card subsystem 1307.

To establish an electrical coupling between the mother board 1302 and the peripheral device board 1304, the first daughter interface 1324 may mate with the second mother interface 1314, and the second daughter interface 1328 may mate with the fourth mother interface 1318. To further secure the first daughter card subsystem 1340 to the mother board subsystem 1300, the plurality of male lock members 1306 may be inserted into the corresponding female lock members 1305. When the first daughter card subsystem 1340 is properly coupled to the mother board subsystem 1300, the first plane 1350 may be arranged perpendicularly to the second plane 1360.

Exemplary embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. An interface system for connecting a first electrical device board with a second electrical device board, comprising:

a first interface configured to be connected to the first electrical device board and including a signal plane having a plurality of signal traces and an interface pin connected to one of the plurality of signal traces, wherein the plurality of signal traces includes a ground signal trace; and a second interface configured to be connected to the second electrical device board and having an interface socket, the interface socket configured to receive the interface pin and establish a plurality of contact lines distributed across a surface of the interface pin.

2. The interface system of claim 1 wherein each of the plurality of contact lines has an angular gradation.

3. The interface system of claim 1 wherein the interface socket is configured to apply a set of normal forces radially across the surface of the interface pin.

4. The interface system of claim 1 wherein the interface socket further comprises a socket wire sleeve having a plurality of contact wires for establishing the plurality of contact lines distributed across the surface of the interface pin.

5. The interface system of claim 4 wherein the plurality of contact wires of the socket wire sleeve are twisted to form a helicoidal mesh surface.

6. The interface system of claim 1 wherein the first interface further comprises:

a connecting surface configured to face the first electrical device board;

a connecting pin protruding from the connecting surface and configured to be inserted into the first electrical device board; and an interface surface supporting the interface pin and configured to be positioned perpendicular to the connecting surface.

7. The interface system of claim 6 wherein the connecting pin is electrically coupled with the interface pin.

8. The interface system of claim 1 wherein the second interface further comprises:

a connecting surface configured to face the second electrical device board;

a connecting pin protruding from the connecting surface and configured to be inserted into the second electrical device board; and an interface surface supporting the interface socket and opposing the connecting surface.

9. The interface system of claim 8 wherein the connecting pin is electrically coupled with the interface socket.

10. An interface system for connecting a mother board with a peripheral device board, comprising:

a daughter interface configured to be connected to the peripheral device board and having a plurality of interface pins, the daughter interface including:

a signal frame including a plurality of signal traces, the plurality of interface pins connected respectively to the plurality of signal traces, the plurality of signal traces including a ground signal trace;

a daughter-interface connecting surface configured to face the peripheral device board, a daughter-interface interface surface positioned perpendicular to the daughter-interface connecting surface and supporting the plurality of interface pins, and a plurality of daughter-interface connecting pins protruding from the daughter-interface connecting surface, connected respectively to the plurality of signal traces and configured to be inserted into the peripheral device board; and a mother interface configured to be connected to the mother board and having a plurality of interface sockets, each interface socket configured to receive one of the plurality of interface pins and establish a plurality of contact lines distributed across a surface of the corresponding interface pin, the mother interface including:

a mother-interface connecting surface configured to face the mother board, a mother-interface interface surface opposing the mother-interface connecting surface and supporting the plurality of interface sockets, and a plurality of mother-interface connecting pins protruding from the mother-interface connecting surface and configured to be inserted into the mother board.

11. The interface system of claim 10 wherein each of the plurality of interface sockets is configured to apply a set of normal forces against the surface of the corresponding interface pin.

12. The interface system of claim 10 wherein each of the plurality of interface sockets is configured to grip the corresponding interface pin with an angular gradation for smooth insertion or extraction of the corresponding interface pin.

13. The interface system of claim 10 wherein the mother interface further comprises a bracket positioned perpendicular to the mother-interface interface surface for protecting a space adjacent to the plurality of interface sockets.

14. The interface system of claim 10 wherein the daughter interface comprises a wafer housing defining a cavity therein, a plurality of signal traces positioned within the cavity of the wafer housing and electrically connecting each of the plurality of daughter-interface connecting pins to one of the interface pins.

15. The interface system of claim 14 wherein the wafer housing further comprises a slot for allowing air flow through the cavity of the wafer housing.

16. The interface system of claim 10 wherein each of the plurality of mother-interface connecting pins is mechanically coupled to one of the plurality of interface sockets to form a plurality of hybrid units, each hybrid unit having a pin end and a socket end.

17. The interface system of claim 16 wherein the mother-interface connecting surface defines a plurality of ports and each of the plurality of hybrid units is positioned in one of the plurality of ports.

18. The interface system of claim 17 further comprising a plurality of polytetrafluoroethylene (PTFE) spacers, each of the plurality of PTFE spacers surrounding one of the hybrid units and positioned in one of the plurality of ports for controlling an impedance through the surrounded hybrid unit.

19. A method for interfacing a first device board with a second device board, comprising:

establishing a first interface including a signal plane having a plurality of signal traces and an interface pin connected to one of the plurality of signal traces and configured to be connected to the first device board, wherein the plurality of signal traces includes a ground signal trace;

establishing a second interface having an interface socket and configured to be connected to the second board; and receiving the interface pin within the interface socket to establish a plurality of contact lines having an angular gradation across a surface of the interface pin.

20. The method of claim 19 wherein the interface socket is configured to apply a set of normal forces against the surface of the interface pin when the interface pin is received by the interface socket.

* * * * *